US006412122B1

(12) United States Patent
Foy et al.

(10) Patent No.: US 6,412,122 B1
(45) Date of Patent: Jul. 2, 2002

(54) ABOVE GROUND SWIMMING POOL SUPPORT STRUCTURE

(75) Inventors: Jérôme Foy, Orford; Serge Provost, St-Laurent, both of (CA)

(73) Assignee: Vogue Pool Products, LaSalle (CA)

( * ) Notice: Subject to any disclaimer, the term of this patent is extended or adjusted under 35 U.S.C. 154(b) by 0 days.

(21) Appl. No.: 09/897,144

(22) Filed: Jul. 3, 2001

Related U.S. Application Data

(60) Provisional application No. 60/216,328, filed on Jul. 5, 2000.

(51) Int. Cl.[7] ..... E04H 4/04
(52) U.S. Cl. ..... 4/506; 52/245
(58) Field of Search ..... 4/506, 513; 52/245, 52/247; 220/4.16, 4.17

(56) References Cited

U.S. PATENT DOCUMENTS 3,874,132 A * 4/1975 Mendelow et al. ..... 4/506 X
4,364,211 A * 12/1982 Arp et al. ..... 52/245
5,231,807 A 8/1993 Aymes ..... 4/506 X
5,425,144 A * 6/1995 Cornelius ..... 4/506
5,875,500 A 3/1999 Shaanan et al. ..... 4/506

* cited by examiner

*Primary Examiner*—Robert M. Fetsuga
(74) *Attorney, Agent, or Firm*—Birch, Stewart, Kolasch & Birch, LLP

(57) ABSTRACT

An above ground swimming pool support structure is made up a plurality of posts, wherein each post is a blow-moulded unit having a base portion and top portion with a planar shoulder. A plurality of universal coping members also blow-moulded are interconnected end to end at selective angles, one end abutting the other at the planar shoulder of each post. A plurality of holes are provided at the opposite ends of the coping members. The connection of the adjacent coping members at the selective angles is maintained by pins inserted into aligned holes at the respective interconnected ends of the adjacent coping members, such that an endless top rail supported by the posts can be formed using the universal coping members for coping a flexible pool panel end to end of an above ground swimming pool in a preselected size. The advantages include the reduced manufacturing cost resulted from the limited number of moulds for manufacturing the moulded components and reduced labour required for erecting the pool.

20 Claims, 20 Drawing Sheets

216
232
230
202
200
204
13c
214
13b
222
13c 204
206
226
220
222
200
224
218
214

200
204
226
A
B
C
220
222
A
B
C
214

316
332
330
302
300
304
322
14b
314

300
304
326
D
F
C
E
B
A
350
322
326
A
F
320
E
D
C
B
314

ABOVE GROUND SWIMMING POOL SUPPORT STRUCTURE

This application claims priority from Proivisional application Ser. No. 60/216,328, filed Jul. 5, 2000.

BACKGROUND OF THE INVENTION

1. Field of the Invention

The present invention relates to an above ground swimming pool and, more particularly, to an above ground swimming pool structure having an endless top rail which is formed by a plurality of universal coping members interconnected to one another at selective angles for coping an endless side wall of an above ground swimming pool in selective sizes.

2. Description of the Prior Art

Present day above ground swimming pools generally have posts and coping structures supporting a single pool panel end to end. However, most such structure rely on nuts and bolts to connect the many posts and coping elements together. On a large pool, the number of posts and coping sections is considerable and, as a result, the number of nuts and bolts that must be utilized is considerable. The labour required for erecting such a pool is, therefore, substantial. Furthermore, the coping members which form an endless top rail are conventionally interconnected to one another at a fixed angle, and the shape and size of the swimming pool depend on the geometry of the coping members. Therefore, the manufacturers have to produce coping members in different geometry for swimming pools of different sizes.

Since the posts and coping members must form an enclosed loop, the elements forming it must be produced with precision. There can be little tolerance when erecting a structure that might measure over 100 feet in terms of the loop being formed.

In order to overcome the problems mentioned above, efforts have been made in the industry. One example is illustrated in U.S. Pat. No. 5,875,500, which is entitled ABOVE GROUND SWIMMING POOL, issued to Shaanan et al. on Mar. 2, 1999. In this patent, Shaanan describes an above ground swimming pool made up of a plurality of posts, wherein each post is a blow-moulded unit having a base portion and a top portion with a coping seat. A plurality of coping members, also blow-moulded, are each telescopingly received in one end to the other at the coping seat at the top of each post, and a one-piece fastener engages the overlapping telescopic ends of the coping members to the top of the post. The top of the flexible wall is retained by the coping member against the post. The telescoping connection is adapted to compensate for any imperfections of the blow-moulded coping members, and the simple, one piece fastener that can be utilized with the components of the swimming pools eliminates the necessity of using a large number of nuts and bolts. However, since the telescoping connection of the coping members permits only an axial but not an angular adjustment, coping members in different geometry are still necessary for forming swimming pools in different sizes and shapes.

Another example is illustrated in U.S. Pat. No. 5,231,807 which is entitled SWIMMING POOL SUPPORT STRUCTURE, issued to Aymes on Aug. 3, 1993. Aymes describes in his patent a swimming pool support structure having elongate upright members to support elongate top rail members. Each top rail member is provided at an end with a connector for pivotally connecting the top rail member to the upright member at the pivot while threaded bolts are provided for fixing the top rail member to the upright member upon the attainment of a desired orientation angle over the top rail member with respect to the upright member.

Nevertheless, one end of one rail member is attached to the top of one post separately from the attachment of the other end of an adjacent rail member to the top of the same post. Such that, the labour required for erecting the pool is significantly increased, at least doubled, as compared with the labour required to jointly attach a pair of overlapping telescopic ends of two adjacent coping members to the top of one post, as described in U.S. Pat. No. 5,875,500. Moreover, since the selected angular position of one top rail member with respect to the post is maintained by hands until the end of the top rail member is securely fastened to the top of the post, a frictional force that is caused from the rotation of the threaded bolt and acts on the surfaces of the post and top rail member in contact with the rotating bolt may change the selected angular position during a fastening action.

SUMMARY OF THE INVENTION

It is an object of the present invention to provide an improved above ground swimming pool support structure that will overcome the problems mentioned above.

It is another object of the present invention to provide an above ground swimming pool support structure wherein universal coping members are provided for pools in selective sizes, therefore, to reduce the manufacturing costs.

It is still a further object of the present invention to provide an above ground swimming pool support structure with a relatively simple configuration for easy manufacturing and installation.

In accordance with one aspect of the present invention, there is a kit provided for an above ground swimming pool support structure. The kit comprises a plurality of posts, elongate coping members and pin members. Each post has a base portion and a top portion, each top portion including a substantially planar shoulder portion. Each elongate coping member is provided respectively at opposite ends with a plurality of holes. The coping members are to be connected to one another at a selected angle and the inter-connected ends of adjacent coping members are adapted to be seated on the planar shoulder portion of the respective posts. Each pin member is adapted for insertion through a selected pair of the respective holes in the respective adjacent coping members to determine the selected angle from a plurality of predetermined angles at which adjacent coping members may respectively be interconnected, so that an endless top rail supported by the posts is formed to cope a side wall to end of an above ground swimming pool in a preselected sizes and shapes.

Each of the coping members preferably includes, at either end, a planar upward joint face and at the remaining end, a planar downward joint face, in which the holes are provided, respectively. The downward joint face of one coping member is adapted to abut the upward joint face of an adjacent coping member and two selective holes in the downward joint face are adapted to align with two selective holes in the upward joint face to permit two of the respective pin members to extend therethrough to determine the selected angle from the predetermined angles so that the adjacent coping members are interconnected at the selected angle.

It is preferable that the holes at the opposed ends of each coping member are distributed in a pattern such that more than one axial position of adjacent coping members relative to each other can be selected when the adjacent coping members are interconnected at the selected angle.

In a more specific embodiment of the present invention, the adjacent coping members are maintained at the selected angular relationship with respect to each other using two pins preferably connected by a link member, each pin being inserted into one of the two pairs of the respectively aligned holes, and fastened to the planar shoulder portion of the post using a fastener extending through an opening provided in each end of the coping member. The fastener is a threaded fastener or a one-piece cam fastener that is described in U.S. Pat. No. 5,875,500, which is incorporated herein by reference.

In accordance with another aspect of the present invention an above ground swimming pool includes a pool panel having upper and lower edges, connected end to end to form an endless side wall of the pool. The swimming pool further includes a plurality of posts to support a plurality of elongate coping members. Each post has a base portion and a top portion, each top portion including a substantially planar shoulder portion. The coping members are angularly interconnected to one another and the angularly interconnected ends of adjacent coping members are seated at the planar shoulder portion of the respective posts to form an endless top rail supported by the posts to cope the endless side wall of the above ground swimming pool in preselected size and shape.

The angle at which the adjacent coping members are interconnected is selected from a plurality of predetermined angles. This is achieved by means of pin members and holes. The holes are provided at opposite ends of the coping members. Each pin member is engaged with a selected pair of holes in the respective adjacent coping member to determine the selected angle. Each coping member is also provided respectively, at the opposite ends, with an opening extending through the end of the coping member.

The holes at the opposite ends of the coping members according to one embodiment of the present invention, are distributed in a pattern such that more than one axial position of adjacent coping members relative to each other can be selected when the adjacent coping members are interconnected at the selected angle. Each coping member preferably includes at either end, a planar downward joint face. The two joint faces have common plane. The downward joint face of an adjacent coping member and preferably, at least two holes in the downward joint face is aligned with two selective holes in the upward joint face to permit two of the respective pin members, which are preferably connected together by a link member, to extend therethrough to determine the selected angle from the predetermined angles.

The present invention advantageously provides a kit for an above ground swimming pool support structure having universal coping members which can be used in swimming pools in different sizes. All elements, the coping members and posts in particular can be moulded of resin material, especially by blow-moulding, nevertheless, other materials such as aluminum can also be used. The number of moulds for manufacturing the moulded components is limited because of the uniform size and geometry of the coping members, and therefore manufacturing costs are reduced. Compared to the prior art, the pool is simple to erect and the precise angular position of the coping members is easy to achieve. The selected angular interconnection of the adjacent coping members are securely maintained by pins or pin members before the coping members are respectively secured to the posts and, therefore, are not affected by a fastening action, by which the angularly interconnected adjacent coping members are fastened to the top portion of the posts. Furthermore, the adjacent coping members are jointly fastened to the top portion of each post by one fastening action only, and as a result, the labour required to erect the pool is significantly reduced.

BRIEF DESCRIPTION OF THE DRAWINGS

Having thus generally described the nature of the invention, reference will now be made to the preferred embodiments thereof and accompanying drawings, showing by way of illustration, in which:

FIG. 14*e* is a partial perspective view of a universal coping member of FIGS. 13*a* and 14*a*, showing an alignment mark;

DESCRIPTION OF THE PREFERRED EMBODIMENT

Figure 1:
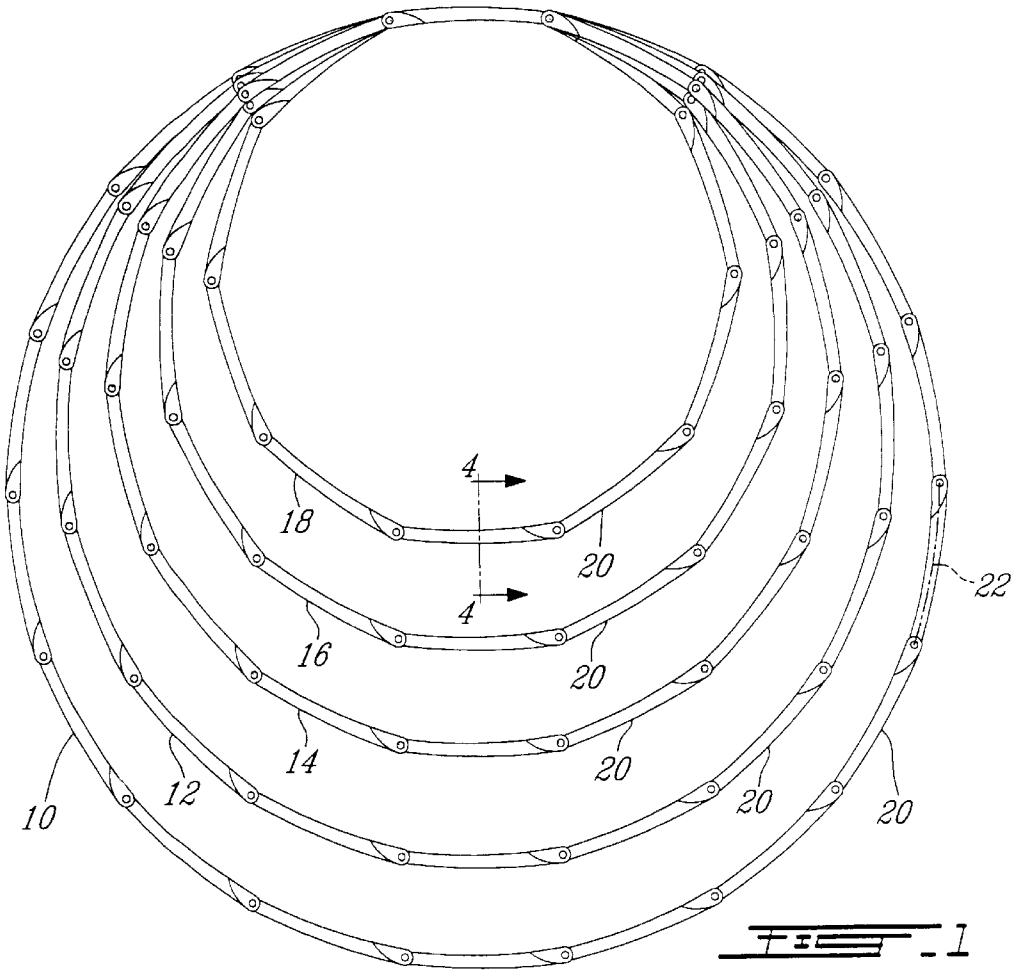
FIG. 1 is a top plan view of support structures for above ground swimming pools in different sizes, including universal coping members according to the present invention (the posts are not shown)
Figure 18:
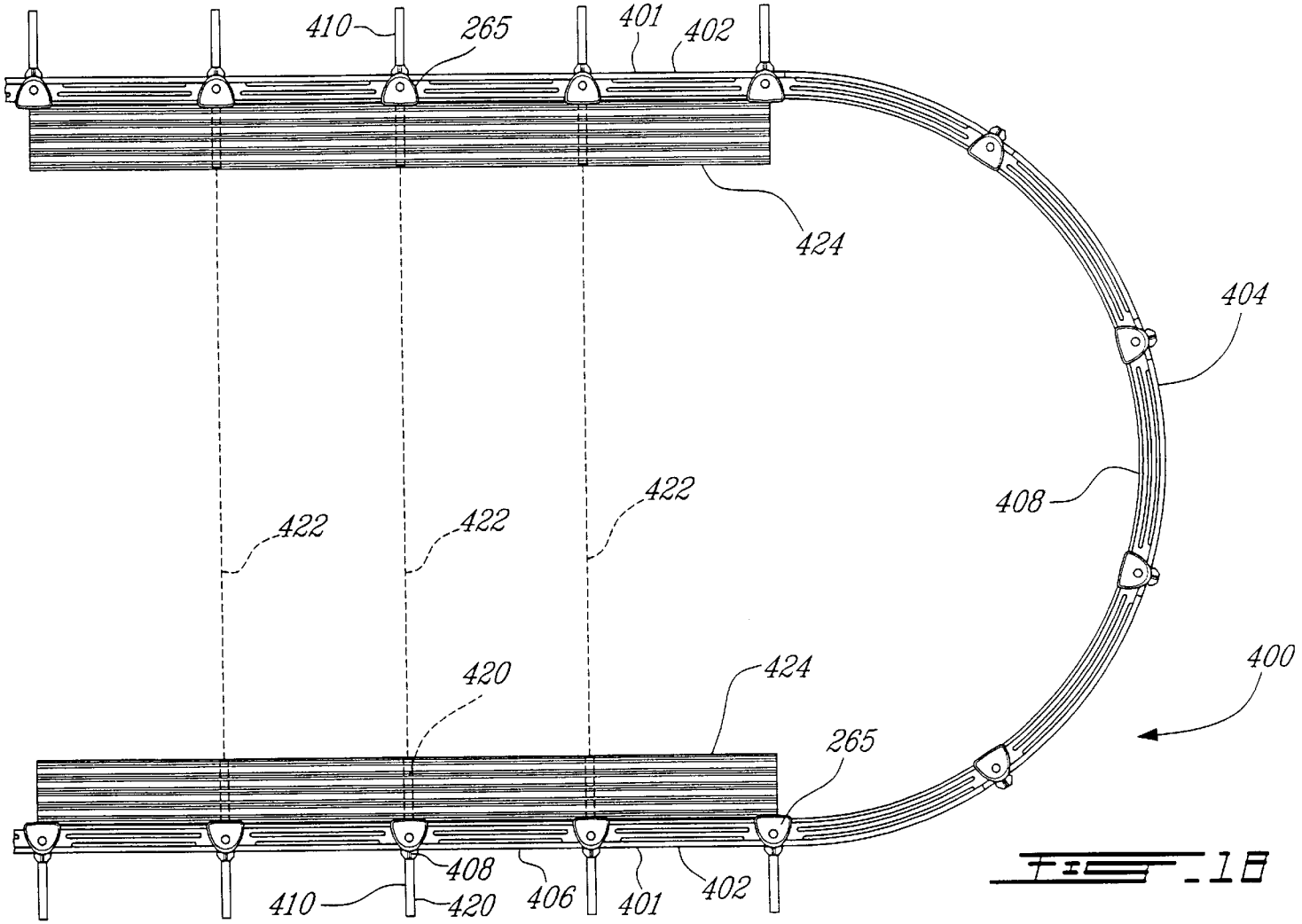
FIG. 18 is a partial top plan view of a support structure for an above ground swimming pool according to another embodiment of the present invention.

In FIG. 1, round swimming pools in different sizes, generally indicated by reference numerals 10, 12, 14, 16 and 18, can be installed using a universal coping member 20. To install swimming pools in different sizes, different numbers of the coping members 20 are used to form an endless loop. Eighteen coping members 20, for example, are used in swimming pool 10 but only twelve for the swimming pool 16. Therefore, the adjacent coping members 20 in the different swimming pools are interconnected at different angles. A particular angle at which the adjacent coping members are interconnected depends on the number of the coping members 20 to form the round loop. The more the coping members 20, the greater the angle. When the length of the coping members is fixed, the angle relates to the size of the swimming pool, which is shown from FIG. 1. Each coping member 20 is elongate, having a longitudinal axis 22, only one is illustrated in FIG. 1. The longitudinal axis 22 is preferred to not be straight except coping members used for the straight part of an oval swimming pool, as shown in FIG. 18, and is curved in a radius the same as the radius of the round swimming pool in the largest size, such as the swimming pool 10.

Figure 9:
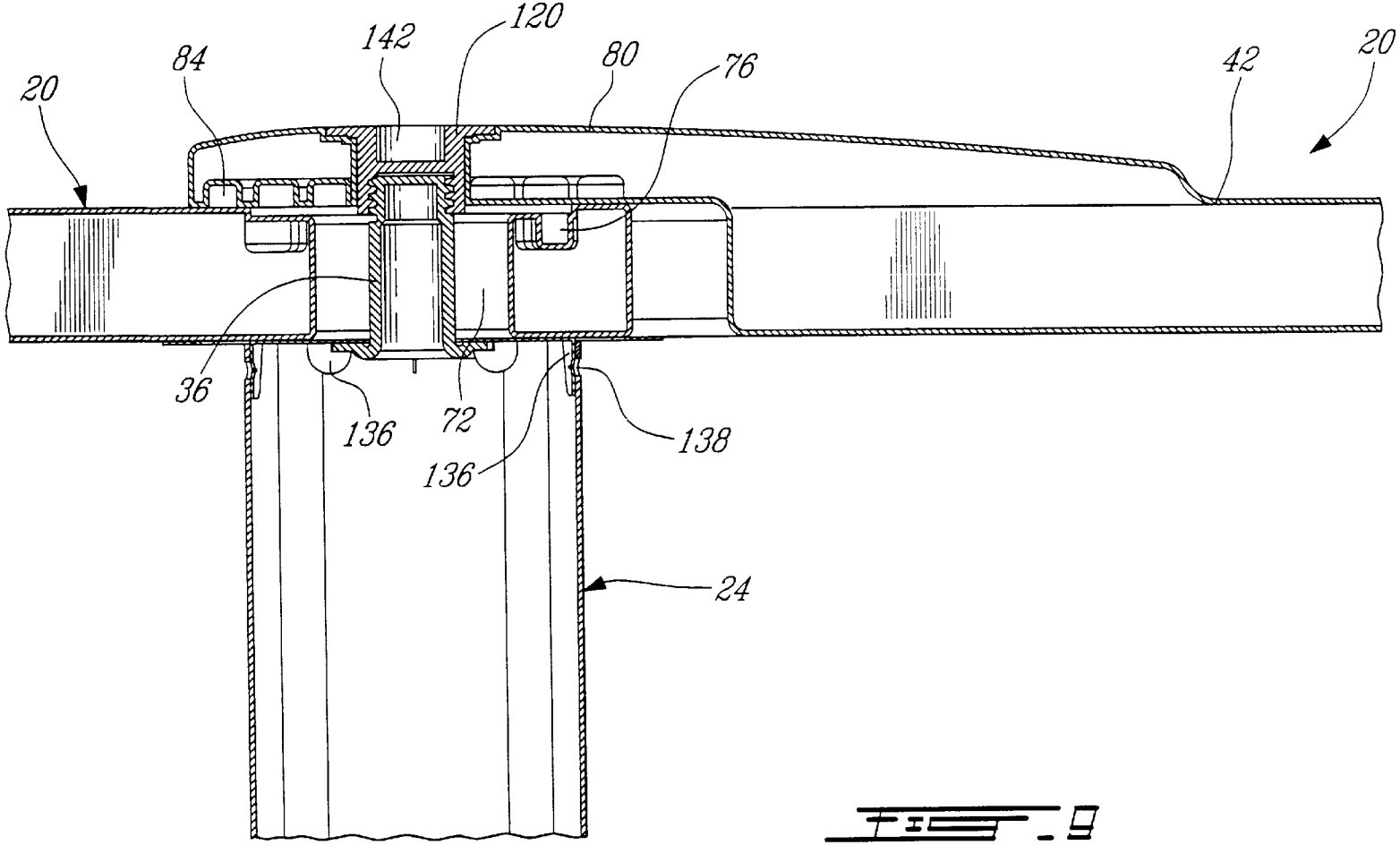
FIG. 9 is a partial and cross-sectional view of a pair of interconnected coping members fastened to the top portion of the post according to one embodiment of the invention.

The coping members 20 are supported at each interconnected joint ends by a post 24, such as shown in FIG. 9. The post 24, according to one embodiment shown in FIG. 2, includes an elongate up-standing blow-moulded plastic member having a base portion 26, a front wall 28 which is a planar flat wall, a rear wall 30 and side walls 32. The post is hollow and has a general structure similar to the posts described in U.S. Pat. No. 5,875,550. The post 24 has a top portion 27 with a planar shoulder portion 34 which is provided as a coping seat and an upstanding member 36. A bracket 38 that is a separate part is provided and detachably secured to the post 24 at the base portion 26, which will be described with more detail below with reference to FIGS. 12*a* and 12*b*.

The coping members 20 may also be made from a blow-moulding process of a suitable thermoplastic material. Several structures of the coping members 20 according to different embodiments are illustrated in FIGS. 3*a*, 3*b*, 3*c*, 3*d*, 3*e* and 3*f*. Each coping member 20 has a beam structure 40 with a top surface 42 and a bottom surface 44. The top surface 42 is normally smooth without any sharp corners, while the bottom structure may be provided with different ribs 52, normally in a recess 46 for receiving a pool panel 48 and a liner 50, shown in FIG. 4. The pool panel is connected end to end to form an endless side wall of the pool along which the liner 50 made of flexible water impermeable material, is attached. In the recess 46, the ribs 52 are positioned so as to form three curved coping grooves 54, 54*a* and 54*b* in respective radii to secure therein the top edge of the pool panel 48. The curved coping grooves 54 and 54*b* are respectively defined between the side surfaces of the recess 46 and an outer side surface of the ribs 52 while the curved coping grooves 54*a* is defined between two inner side surfaces of the ribs 52. The curved coping groove 54*b*, in the greatest radius, is used to secure a pool panel of swimming pools in larger sizes; the curved coping groove 54 in the smallest radius, is used to secure a pool panel of swimming pools in smaller sizes; and the curved coping groove 54*a*, in the intermediate radius, is left for a pool panel of swimming pools in intermediary sizes. The numbers and positions of the ribs 52 may be varied in different embodiments, which are clearly illustrated through FIGS. 3*a* to 3*e*.

Figure 4:
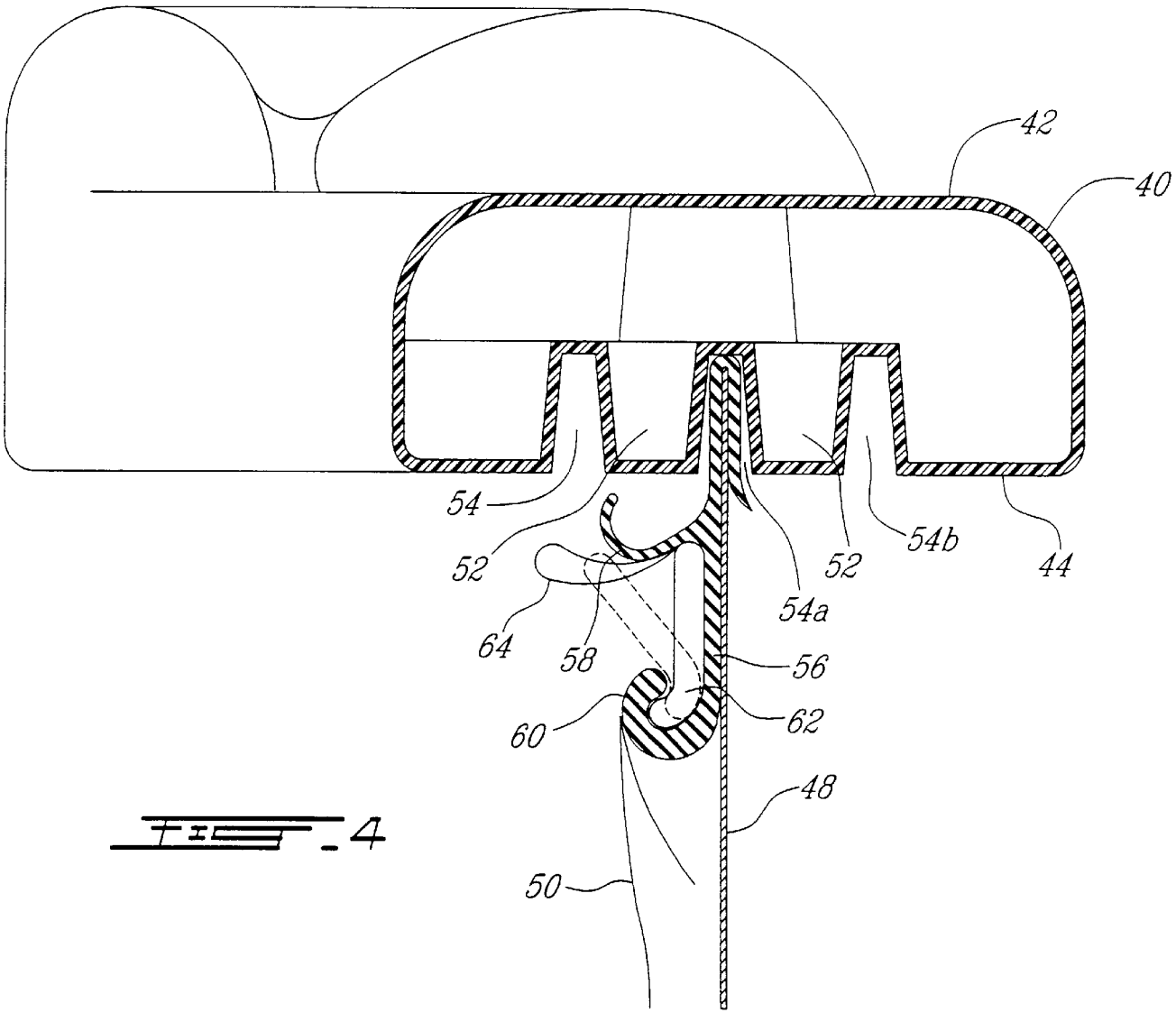
FIG. 4 is a partial cross-sectional view taken along line 4 in FIG. 1, showing the universal coping member that copes a pool panel with a pool liner attached.

In FIG. 4, a liner attachment member 56 is a flexible but relatively hard plastic strip, having a length equal to the pool panel 48. The liner attachment member 56 in cross-section includes vertically spaced-apart hook-like structures 58 and 60 at its lower portion to form a recess for receiving a flat strap 62, that is also made of flexible but relatively hard plastics and presses the liner 50 into the recess. The liner 50 is tightly bounded by the flat strap 62 to the liner attachment member 56. The flat strap 62 can be pressed without use of any tools from a position, that is illustrated by the dotted line into the recess, because of the flexibility and geometry of the hook-line structure 58. However, a tool with a tip member which is schematically illustrated in FIG. 4 and indicated as 64, may be needed for removal of the flat strap 62 from the recess. The top portion of the liner attachment member 56 is folded down to wrap the top edge of the pool panel 48 and the wrapped top edge of the pool panel 48 is then snugly inserted into one of the curved coping grooves 54, 54*a*, 54*b*, such that the liner attachment member 56 is secured to the top edge of the pool panel 48 at the inner side for the attachment of the swimming pool liner 50.

Figure 3A:
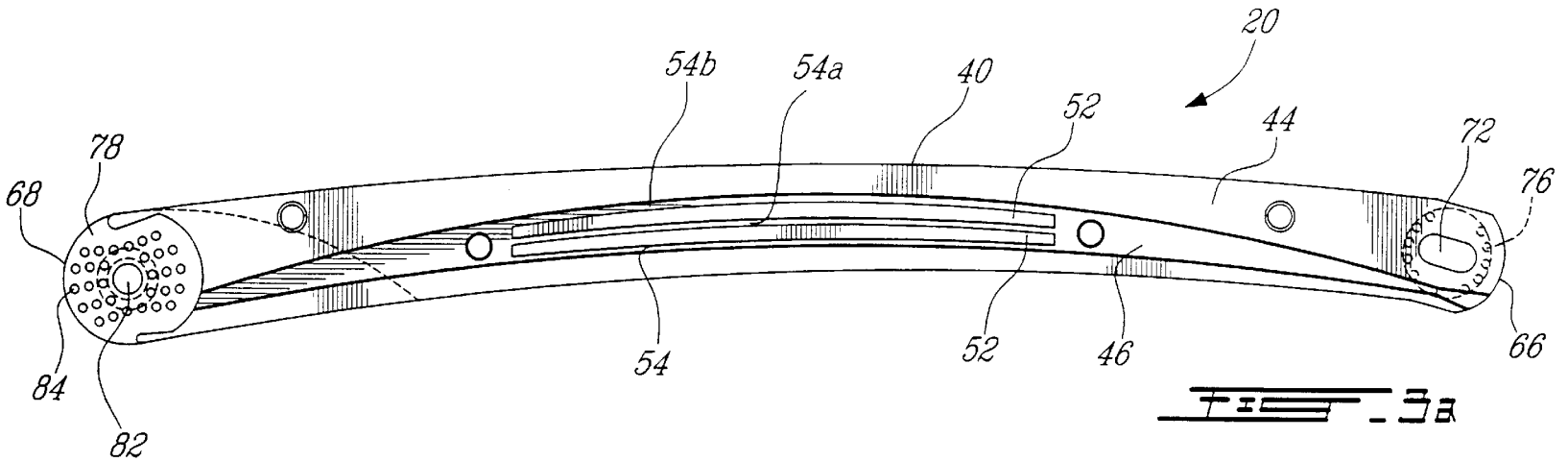
FIGS. 3*a* and 3*b* are bottom plan views of the universal coping member according to different embodiments of the invention.
Figure 3B:
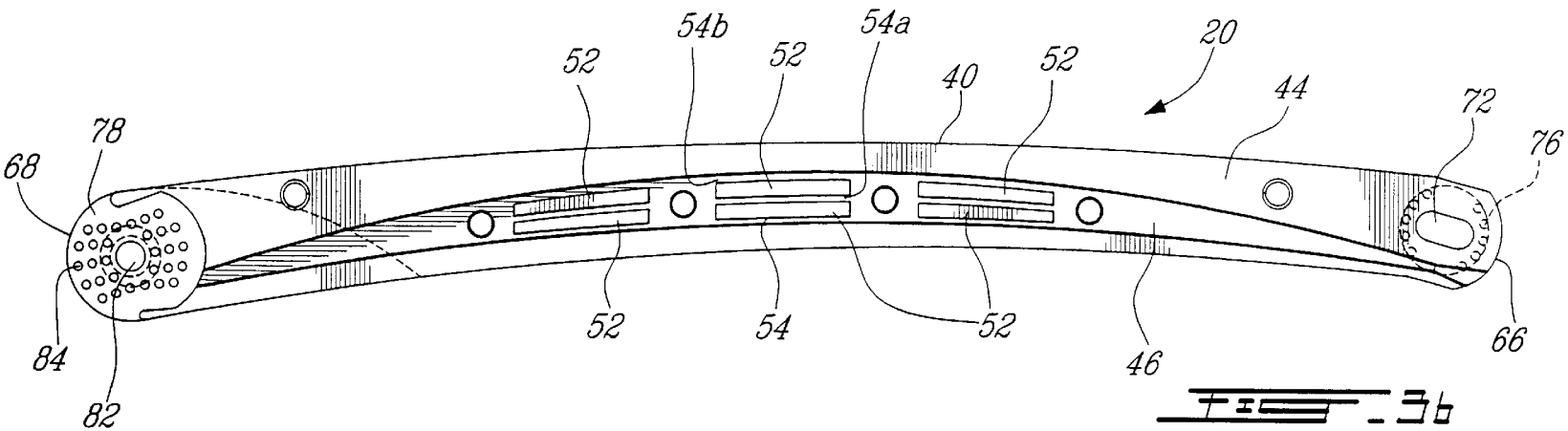
Figure 3C:
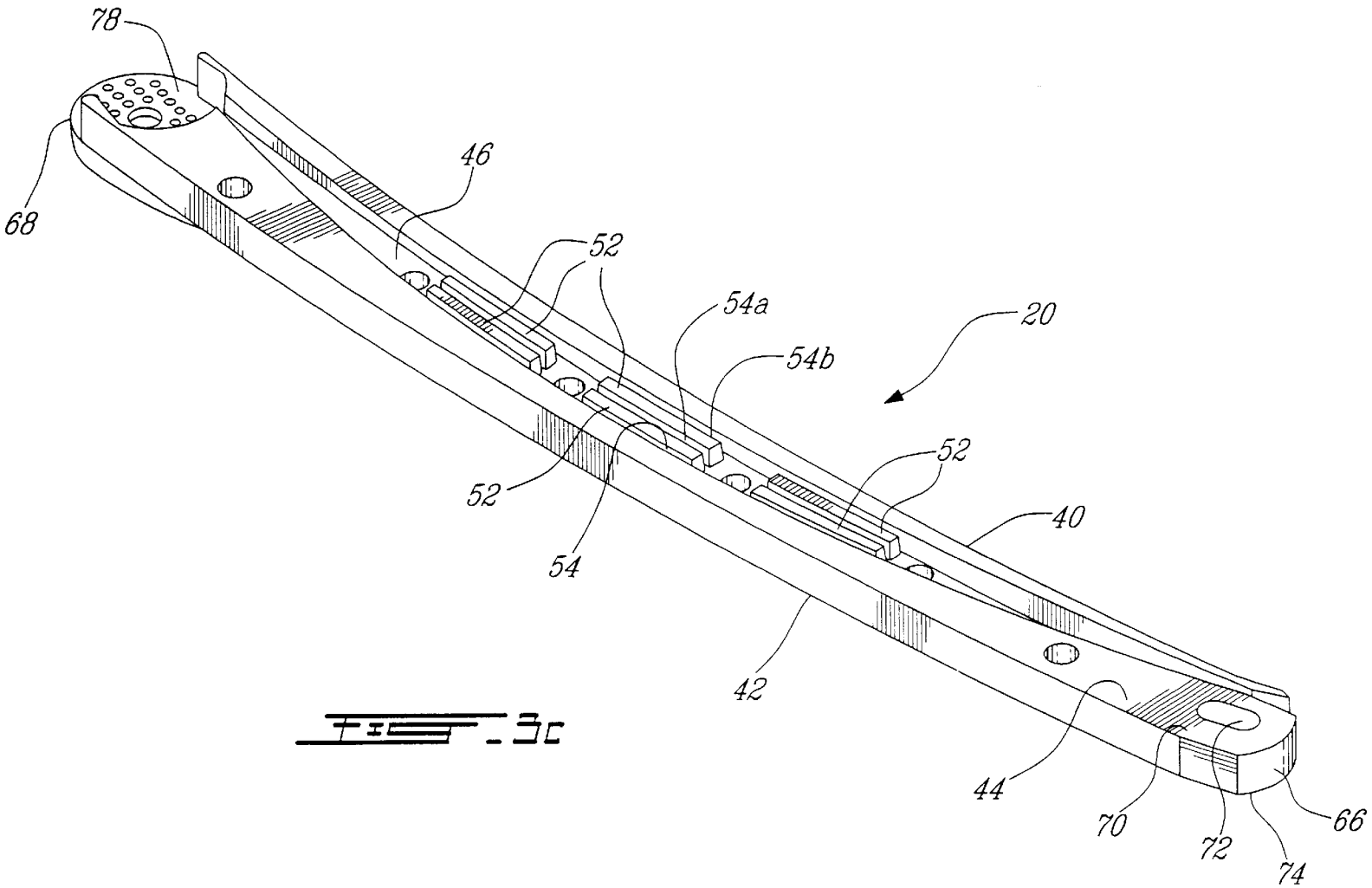
FIG. 3*c* is a perspective view of the universal coping member in FIG. 3*b*, in a upside down position, showing the bottom surface thereof.
Figures 3D, 3E:
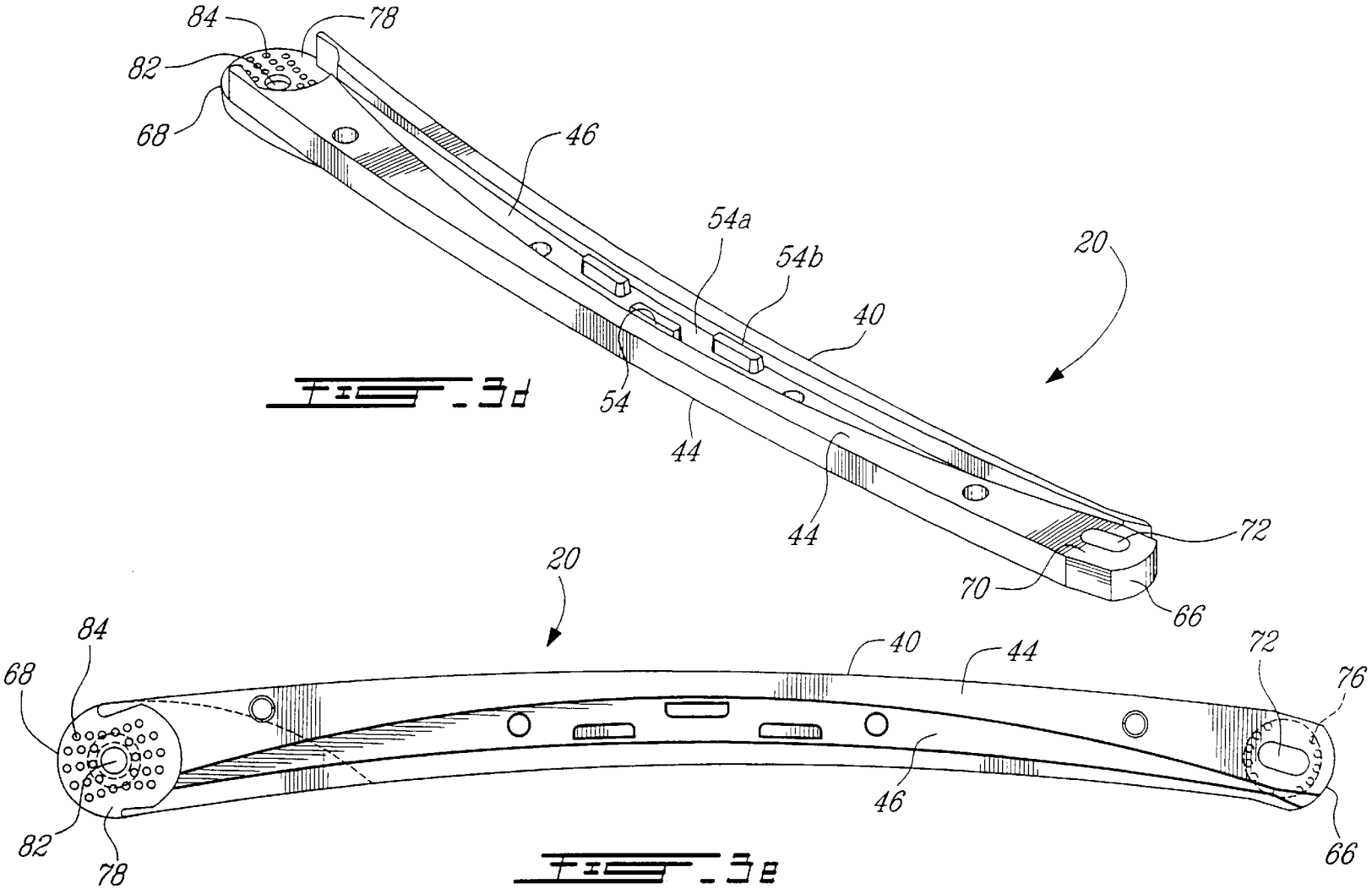
FIGS. 3*d* and 3*e* are perspective and bottom plan views of the universal coping member according to another embodiment of the invention, the universal coping member in FIG. 3*d* being in a upside down position to show the bottom surface thereof.
Figure 3F:
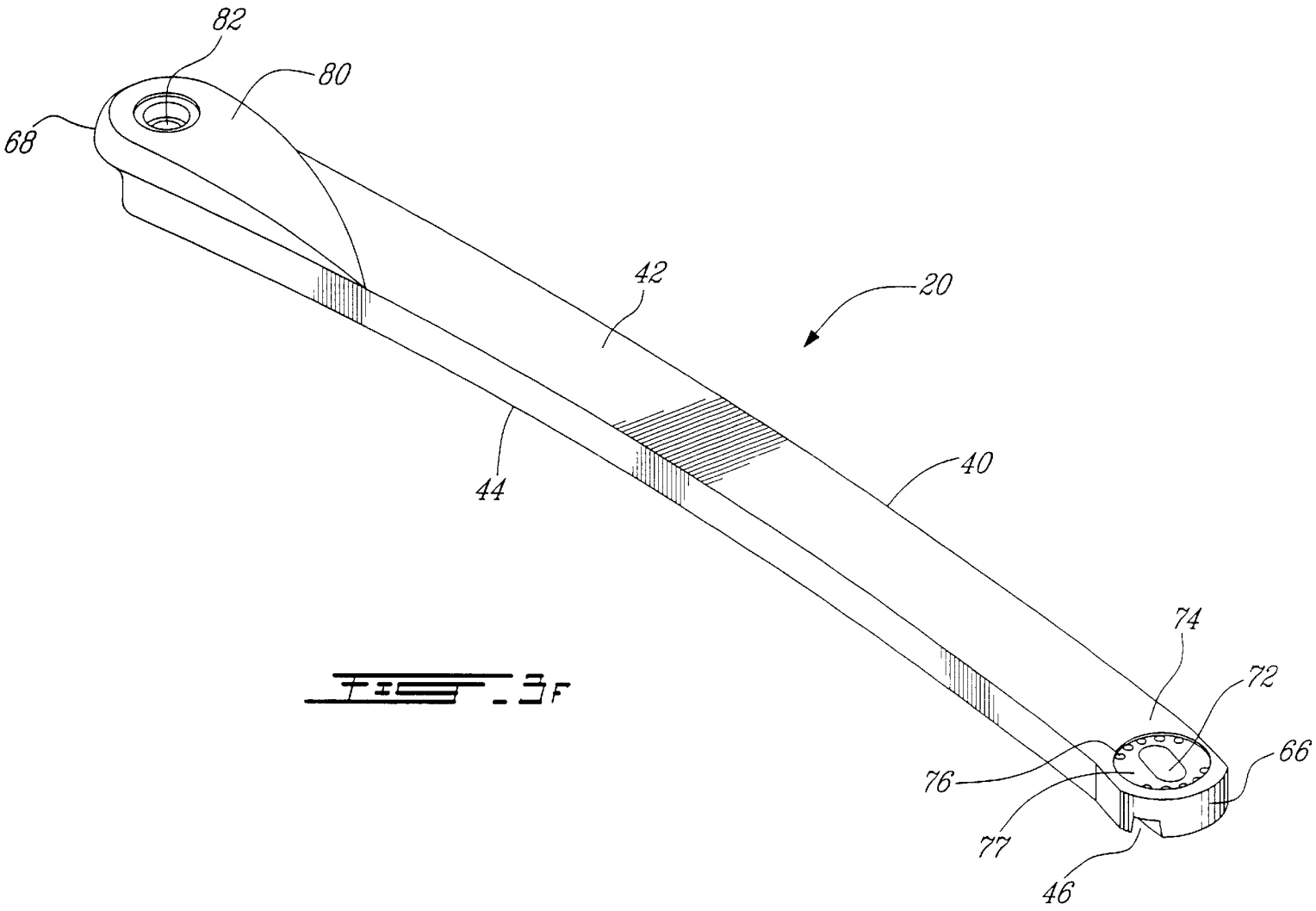
FIG. 3*f* is a perspective view of the universal coping member in FIGS. 3*a* through 3*e* showing the top surface thereof.
Figure 5:
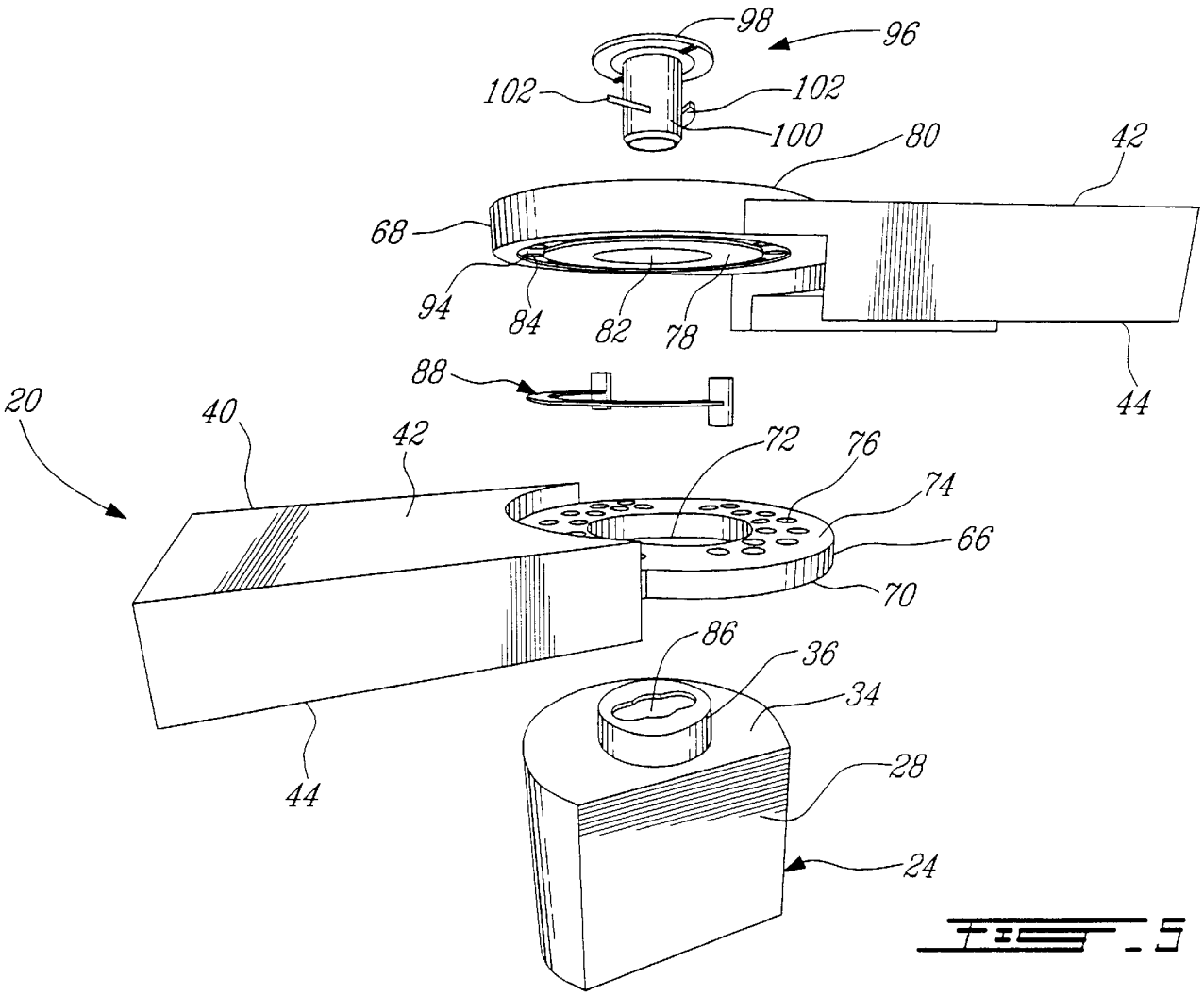
FIG. 5 is an exploded view of two adjacent coping members to be interconnected at selective angles.

Each coping member has joint ends 66, 68 at opposite ends with rounded extremities. One joint end 66 includes a flat seating face 70 having an aperture 72 extending perpendicularly with respect to the seating face 70 and through the end. The flat seating face 70 may be a part of the bottom surface 44 of a beam structure 40, as shown in FIGS. 3*a* to 3*f*, and the aperture 72 is adapted to receive the upstanding member 36 of the post 24 or other fasteners used in different embodiments, which will be described hereinafter. The joint end 66 further includes an upward joint face 74 in a parallel relationship with the seating face 70, which is more clearly shown in FIGS. 5 and 8. A plurality of holes 76 in the upward joint face 74 around the apertures 72 may not necessarily extend through the seating face 70. The holes 76 are illustrated in dotted lines in FIGS. 3*a*, 3*b* and 3*e*, and are more clearly shown in FIGS. 3*f* and 5. The upward joint face 74 may be a part of the top surface 42 of the beam structure 40, even though a shallow recess 77 may also be defined in the central area of the upward joint face 74 as shown in FIG. 3*f*. However, the upward joint face 74 may not be flash with the top surface 42 of the beam structure 40, as illustrated in FIG. 5. At the other end, the joint end 68 includes a downward joint face 78 that is offset from the bottom surface 44 and level with the upward joint face 78 at the joint end 66 to ensure that the two interconnected adjacent coping members 20 are level with each other when the downward joint face 78 abuts the upward joint face 74 of an adjacent coping member for interconnection. The joint end 68 further includes a projecting portion 80 for both the strengthening function and the decorative feature. The projection portion 80 is an integral part of the beam structure and extends smoothly from the top surface 42, as shown in FIGS. 3*f* and 9 An aperture 82 extends perpendicularly with respect to the downward joint face 78 and through the joint end 60 for receiving a fastener to lock the interconnected coping members 20. The holes 84 do not extend through the surface of the projecting portion 80. A plurality of holes 84 are provided around the aperture 82 in the downward joint face 78 for selectively aligning holes 76 in the upward joint face 74 of the adjacent coping member 20. The recess 46 in the beam structure 40 has two openings near the respective joint ends 66 and 68 and extends between the two openings in such a curve that the pool panel 48 received in the recess 46 extends past the posts 24, which support the coping members 20 at the respective joint ends 66, 68, on the side of the front wall 28 regardless of which is selected from the curved grooves 54, 54*a*, 54*b* to secure the pool panel 48.

Figure 6:
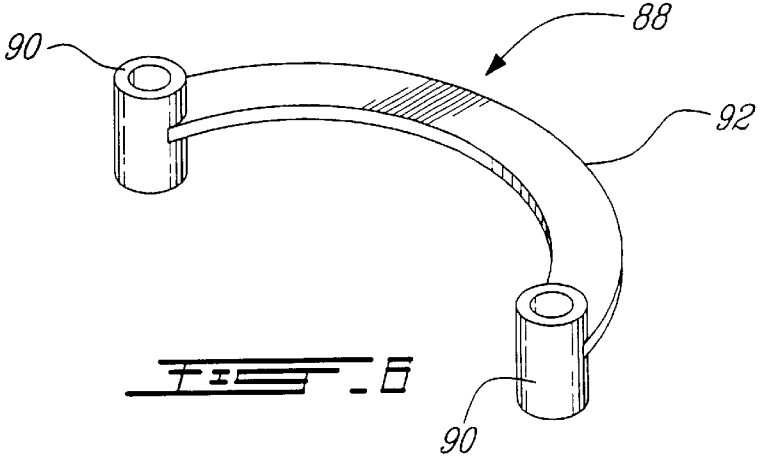
FIG. 6 is a perspective view of a pin element used for the interconnection of the adjacent coping members shown in FIG. 5.

According to one embodiment, the interconnection of the adjacent coping members is illustrated in FIG. 5. The top portion of the post 24 has the planar shoulder portion 34 with the upstanding member 36 that includes an elongate aperture 86. The joint end 66 of one coping member 20 is first placed to the top portion of the post 24 with the seating face 70 seated at the planar shoulder portion 34, the upstanding member 36 extending through the aperture 72 of the joint end 66. A pin connector 88 having two pins 90 interconnected by a half-ring member 92, more clearly illustrated in FIG. 6, is provided for interconnection of two pair of holes selected from holes 76 and 84. The lower portion of each pin 90 is placed in a selected hole 76 in the joint end 66 and the top portion of each pin 90 extends from the upward joint face 74. The joint end 68 of the other coping member 20 is placed above the joint end 66 at a selected angular relationship with respect to the adjacent coping member 20. In this angular position, two corresponding holes 84 in the downward joint face 78 of the joint end 68 must be aligned with and receive the two pins 90 when the joint end 68 is lowered down and the downward joint face 78 abuts the upward joint face 74. The half-ring member 92 of the pin connector 88 is received within an annular recess 94 defined in downward joint face 78 of joint end 68 to prevent interference with the mating of two joint faces 74, 78. A fastening member 96 is provided to secure the interconnected joint ends 66, 68 in the selected angular relationship to the top of the post 24. The fastening member 96 includes a cap 98 with a socket (not shown) defined therein from the top. A stem 100 extends downwardly from the cap 98 and a pair of diametrically opposed wings 102 extends from the bottom of the stem 100. The wings 102 include camming surfaces, which is clearly describes in U.S. Pat. No. 5,875,500.

When it is desired to connect post 24 with a pair of coping members 20, the fastening member 96 is inserted through the openings 82 and 72 with the wings 102 aligned with the major axis of the elongate aperture 86. The fastening member 96 is pushed down until the wings 102 are within the post 24, that is, through the elongate aperture 86. The fastening member 96 is then rotated 90° by means of a suitable tool inserted in the socket. By rotating the fastening member 96, the camming surfaces of the wings 102 will engage the interior of the upstanding member 36 to tightly sandwich the elements together.

Figure 7A:
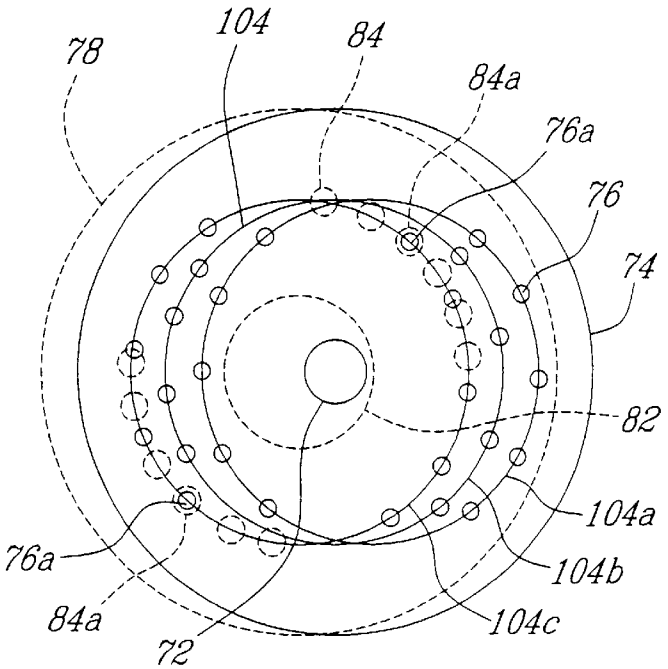
FIG. 7*a* is a schematic view of a mating plane of the adjacent coping members, showing a hole-matching method for interconnection of the adjacent coping members selectively at a plurality of predetermined angles according to the embodiment shown in FIG. 5.

FIG. 7*a* illustrates an example of positioning the holes 76 and 84 in the upward and downward joint faces 74, 78 and matching two pairs of the holes for a selected angle at which the two adjacent coping members are interconnected. In the upward joint face 74, the holes 76 are provided at three rings 104*a*, 104*b* and 104*c* which have the same diameter and are positioned eccentrically from each other. The holes 84 (in broken lines) in the downward joint face 78 (also in broken lines) are provided at a ring 104 which has the same diameter as the other rings and is shown in a position concentric with the ring 104*c*. The holes 76 and 84 at each ring are spaced apart from each other equally, but not necessarily. The holes in each ring, however, must be positioned diametrically opposed, that is, each hole 76 or 84 always has a corresponding hole at the same ring on the same diametric line. The space between two adjacent holes 84 at the ring 104 is preferably different from the spaces between two adjacent holes 76 at the rings 104*a*, 104*b* and 104*c* so that there is always a pair of diametrically opposed holes 84, but only one pair, which can be matched with a pair of diametrically opposed holes 76 when the ring 104 is placed concentrically with one of the rings 104*a*, 104*b* and 104*c* and rotated to a certain position. For example, holes 84*a* at the ring 104 are matched to the holes 76*a* at the ring 104*c*, as shown in FIG. 7*a*. The round aperture 72 provided at the center of the upward joint face 74 to receive the upstanding member 36 of the post 24 therethrough is slightly greater than the periphery of the upstanding member 36 to restrict the movement of the coping member 20 with respect to the post 24. The round aperture 82 in the center of the downward joint face 78, however, must be greater than the aperture 72 to permit the ring 104 to be positioned concentrically with any of the rings 10*a*, 10*b*, 10*c*, while the aperture 82 is still sufficiently overlapped with aperture 72 to permit the upstanding member 36 or other fasteners therethrough. Each pair of the diametrically opposed holes 84 can determine one angular position when they match each pair of the diametrically opposed holes 76 so that the total number of angular positions which may be selected is resulted from that the number of the pair of diametrically opposed holes 84 times the number of the pair of diametrically opposed holes 76, if the positions of the holes 76 at rings relative to one another are carefully arranged to avoid one angular position repeatedly determined by two matches of one specific pair of diametrically opposed holes 84 with two pair of diametrically opposed holes 76 at two different rings.

Various embodiments based on the example illustrated in FIG. 7*a* may be configured in different structures. For example, the aperture 82 may be sized to fit the upstanding member 36 or a fastener while the aperture 72 is greater, which is shown in FIG. 5. In that embodiment, the upstanding member 36 should be higher than the thickness of the joint end 66 to extend into the aperture 82 of the joint end 68 to restrict the movement of the interconnected coping members 20.

Figure 7B:
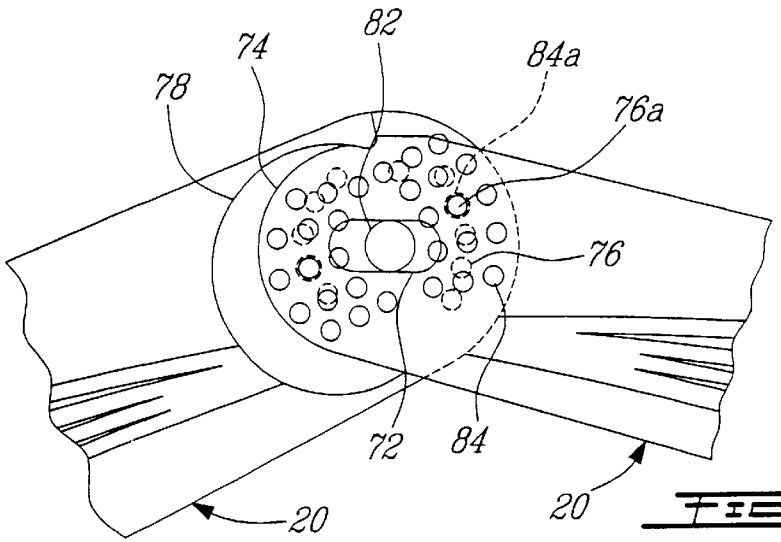
FIG. 7*b* is a schematic view showing a mating plane of the adjacent coping members, showing the hole-matching method for the interconnection of the adjacent coping members according to the embodiments shown in FIGS. 3*a*, 3*b*, 3*e* and 3*f;*

FIG. 7*b* illustrates a variation of the example shown in FIG. 7*a*. Instead of being a pair of round apertures having different sizes as 72, 82, shown in FIG. 7*a*, the aperture 82 in FIG. 7*b* is round and slightly greater than the upstanding member 36 or a fastener, and the aperture 72 is elongated, having a short axis equal to the diameter of the aperture 82 and a major axis. The major axis is greater than the diameter of the aperture 82 to permit the upward joint face 74 to rotate and move along the major axis with respect to the down joint face 78. The holes 76, 84 positioned at the respective rings are not diametrically opposed. In each selected angular position of the coping member 20 with respect to each other, there is always only one hole 76 in the upward joint face 74 aligned with hole 76 in the downward joint face 78 as indicated by 76*a*, 84*a* in FIG. 7*b*. A pin inserted into the holes 76*a*, 84*a* and the upstanding member 36 or a fastener extending through the elongate aperture 72 and the round aperture 82 to determine the selected angle when the aligned holes 76*a* , 84*a* are not located on a line which extends through the center of the aperture 82 and perpendicular to the major axis of the elongate aperture 72. This variation advantageously provides more selections of the angular position when the number of holes 76 and 84 is not increased. The holes are not diametrically opposed and only one hole 76 is needed to be matched with a corresponding hole 84 to receive a pin 90 therein to restrict movement of the coping member 20 with respect to the adjacent one, since the relative rotation about the pin 90 is restricted by the upstanding member 36 or a fastener extending through the elongate aperture 72 and the round aperture 82. The physical structure of the coping member 20 including this variation is illustrated through FIG. 3*a* to FIG. 3*f*.

Figure 8:
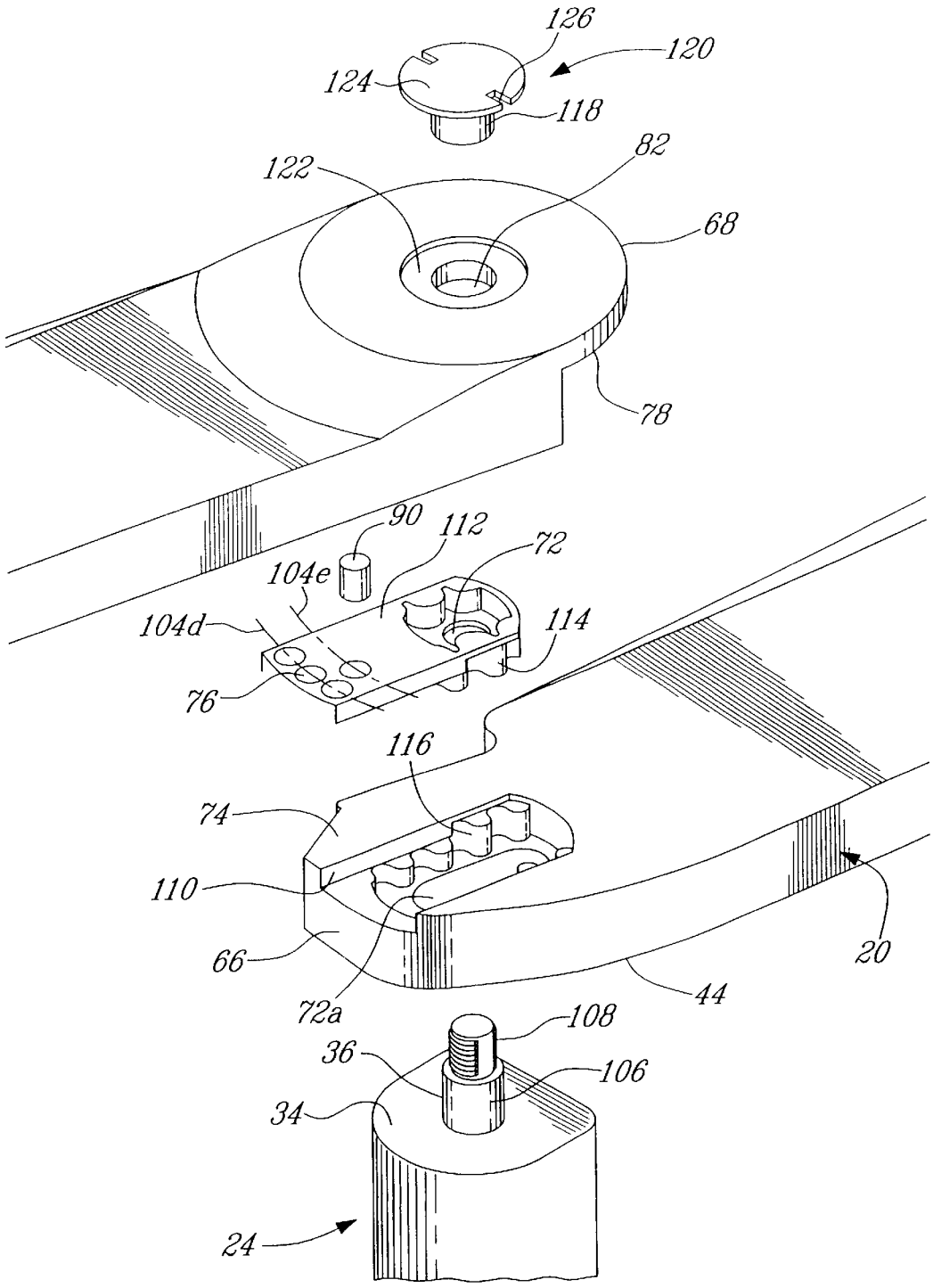
FIG. 8 is an exploded view of two adjacent coping members interconnected at selective angles according to a further embodiment.

Another embodiment of the invention is based on a variation illustrated in FIG. 8. The post 24 includes a top portion having the planar shoulder portion 34 with the upstanding member 36 having a pin portion 106 and a threaded top end 108. The joint end 66 includes the upward joint face 74 having an elongate recess 110 that extends inwardly and longitudinally from the rounded extremity of the coping member 20. An elongate sliding plate 112 is provided for insertion into the elongate recess 110 and the holes 76 are provided through the plate at one end while a toothed connector 114 is projected from the bottom face of the plate at the other end. The aperture 72 extends through the projecting tooth connector 114 and may include an enlarged top portion having a shape corresponding to the projected toothed connector 114 for the purpose of even distribution of materials during the blow-moulding process. A toothed connector 116 is provided to two interior sides of the elongate recess 110, which may not extend through the full length of the elongate recess 110, as shown in FIG. 8. Thus, the sliding plate 112 can be received in the elongate recess 110 in one of several longitudinally selective positions. The structures shown in FIG. 8 allow for three positions to be selected. The joint end 68 has a similar structure as shown in FIG. 5, which has the aperture 82 slightly greater than a stem 118 of a fastener 120 and an enlarged recess 122 to receive a cap member 124 of the fastener 120. The cap member 124 includes a pair of diametrically opposed slots 126 for receiving a suitable tool to rotate the fastener 120. The stem 118 of the fastener 120 is hollow and provided with female threads, not shown, for connection with the threaded top end 108 of the upstanding member 36 of the post 24. The holes 84 in the downward joint face 78 are not shown, which must be arranged at rings concentric with the aperture 82 and have diameters that are the same as the respective rings 104*d*, 104*e* on the sliding plate 112. The rings 104*d* and 104*e* are also concentric with the aperture 72 that is slightly greater than the pin portion 106. The pin 90 inserted into one of the holes 76 in the sliding plate 112 and a corresponding hole in the downward joint face 78 at a ring having the same diameter will give a selected angular position of the interconnected coping members 20 with respect to each other. However, the holes in the downward joint face 78 at a ring cannot align any hole 76 in the sliding plate 112 at a ring having different diameters regardless of the selected insertion of the sliding plate 112 into the elongate recess 110. The distance from the center of the aperture 72 which serves as a rotating center to any selected hole 76 in the sliding plate 112 cannot be adjusted by moving the sliding plate, and therefore, is not able to match the different distances from the center of the aperture 82 which serves as the same rotating center to holes in the downward joint face 78 at different rings. Thus, the selective insertion of the sliding plate 112 into the elongate recess 110 generally does not provide more selection for angular positions but gives a longitudinal adjustment for the interconnection of coping members 20 to compensate for imperfection of the coping members 20. An elongate aperture 72*a* is provided in the bottom of the elongate recess 110, extending through the bottom surface 44 to permit the upstanding member 36 of the post 24 to extend through the aperture 72 in the sliding plate 112 when the sliding plate 112 is placed in different positions in the elongate recess 110.

Nevertheless, the sliding plate structure may have advantages for selection of angular positions when slight modifications are made. If the structures of the sliding plates 112 and the elongate recess 110 are changed to permit the insertion of the sliding plate 112 in both opposite orientations, or upside down into the elongate recess 110 while the holes 76 in the sliding plate 112 are not positioned symmetric about the longitudinal axis of the sliding plate 112, different positions of the sliding plate 112 in the elongate recess 110 do provide more selections of angular positions of the coping members with respect to each other. In the former case, the holes 76 at the ring 104*d*, for example, can selectively match all the number of the respective holes at the same ring in the downward joint face 78 when the sliding plate 112 is adapted to be placed in the recess 110 at both orientations while only half the number of the respective holes at the same ring in the downward joint face 78 can be selectively matched when the sliding plate 112 is only adapted to be placed in the recess 110 in one orientation. In the latter, the holes 76 are angularly positioned differently with respect to the center of the aperture 72 as to increase the number of the holes 76 at the same ring when the sliding plate 112 is placed into the recess 110 upside down. Another simple modification can be done by making the fitted aperture 72 an elongated one to permit changes of the pivoting radius from the center of the upstanding member 36 to the selected holes 76 in the sliding plate 112 to match a radius of a ring at which a selected hole in the downward joint face 78 is located. All of these modifications will be well understood by those skilled in the art from the above-description and illustration in the drawings and are not further described in detail.

FIG. 9 shows a partial cross-sectional view of interconnected coping members 20 secured to the top of the post 24 by the fastener 120. The coping member 20, shown in FIG.

Figure 10:
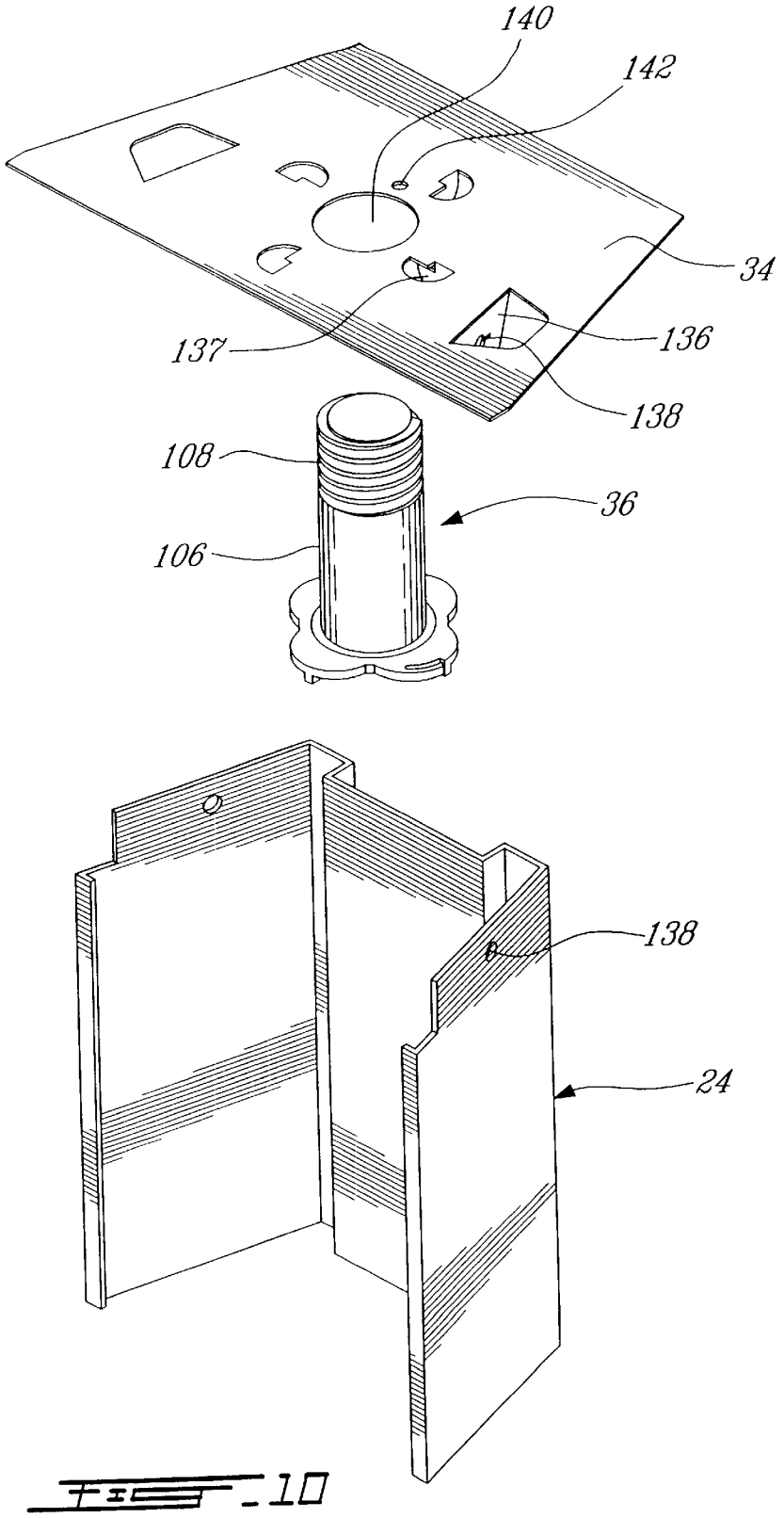
FIG. 10 is an exploded view of a top portion of the post used in the embodiment of FIG. 9.
Figure 11A:
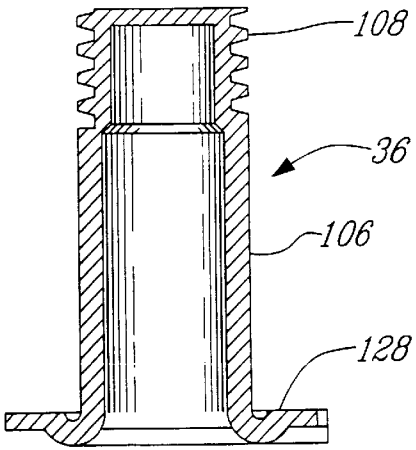
FIGS. 11*a* and 11*b* are cross-sectional and bottom plan views of a pin member used to form the top portion of the post shown in FIG. 10.
Figure 11B:
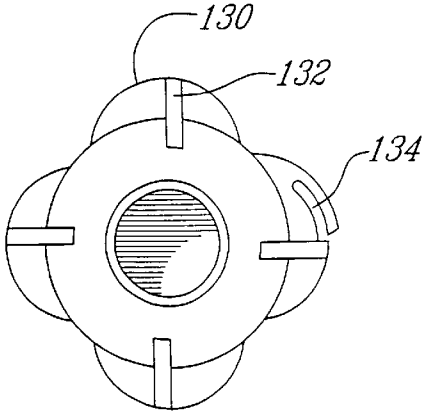

9, is one of the embodiments illustrated in FIG. 3*a* to FIG. 3*f*. The upstanding member 36 is a separate part detachably secured to the top of the post 24. The upstanding member 36 is more clearly shown in FIGS. 10, 11*a* and 11*b*, having the pin portion 106 and the threaded top end 108. A base plate 128 is provided at the bottom of the pin portion 106, extending radially and outwardly, and forming four equally and circumferentially spaced-apart rounded projection 130, as shown in FIG. 11*b*. Four ribs 132 are provided on the bottom side of the base plate 128 at the respective rounded projections 130, offset from the centric line of each projection 130. One of the projections 130 includes a curved slot 134 extending therethrough with an entry at the top of the projection 130. The upstanding member 36 is hollow and is also made through the blow-moulding process. The planar shoulder portion 34 of the post 24 is made a plate with cuts therein to form tabs 136, 137 as illustrated in FIG. 10. When the upstanding member 36, the planar shoulder 34 and the post 24 are assembled together as illustrated in FIG. 9, the two bigger tabs 136 are secured to the sidewall of the post 24 by fasteners, not shown, through the holes 138, and the upstanding member 36 is received in a central aperture 140 and attached to the shoulder portion 34 by a pair of bolt and nut (not shown) received in the curved slot 134 of the upstanding member 36 and a hole 142 of the shoulder portion 34. The four smaller tabs 137 are positioned between adjacent rounded projections 130 to restrict the rotation of the upstanding member 36 with respect to the post 24. The fastener 120 has a polygonal recess 142, instead of the diametrically opposed slots 126, as illustrated in FIG. 8, for receiving a suitable tool to rotate the fastener.

Figure 2:
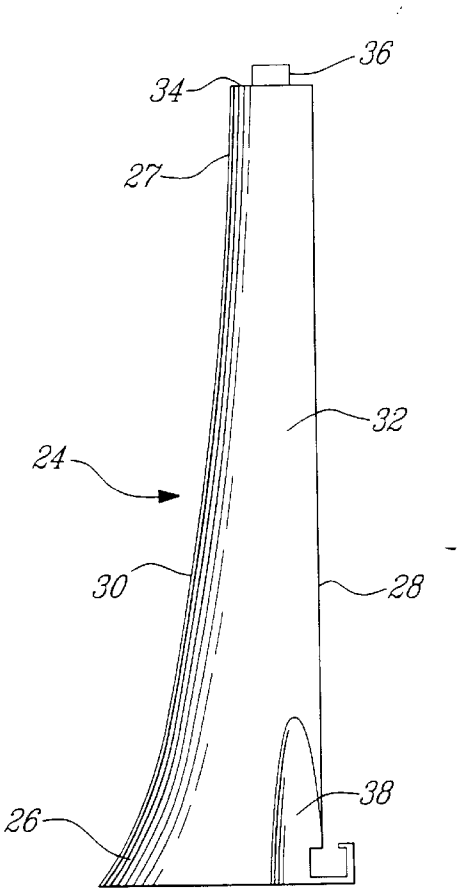
FIG. 2 is an elevational side view of a post for supporting the universal coping members in FIG. 1.
Figure 12A:
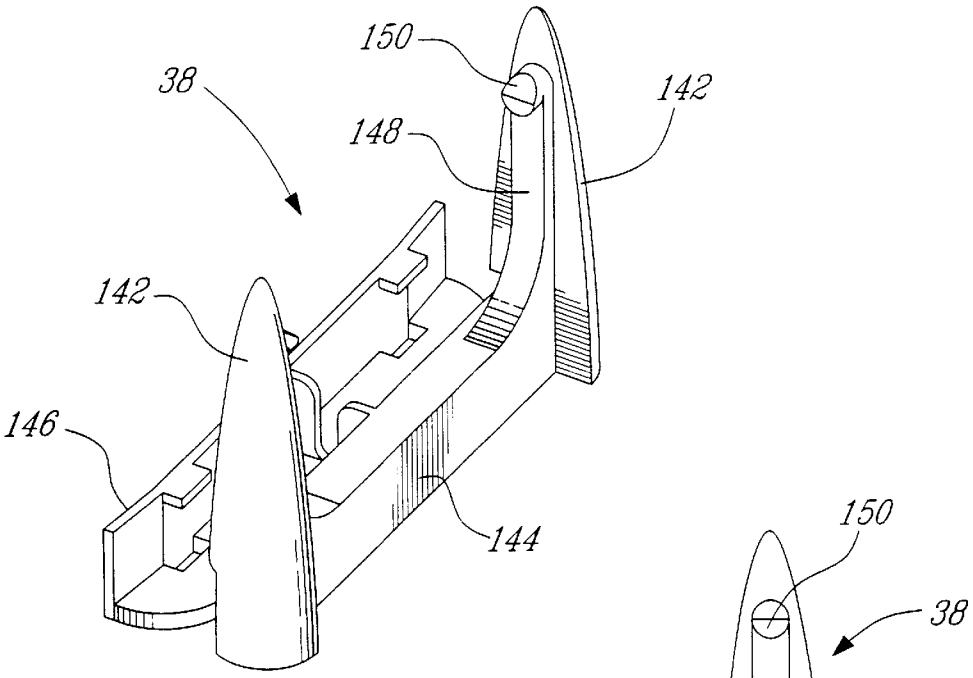
FIGS. 12*a* and 12*b* are respective and cross-sectional views of a bracket which is provided at the base of the post, shown in FIG. 2.
Figure 12B:
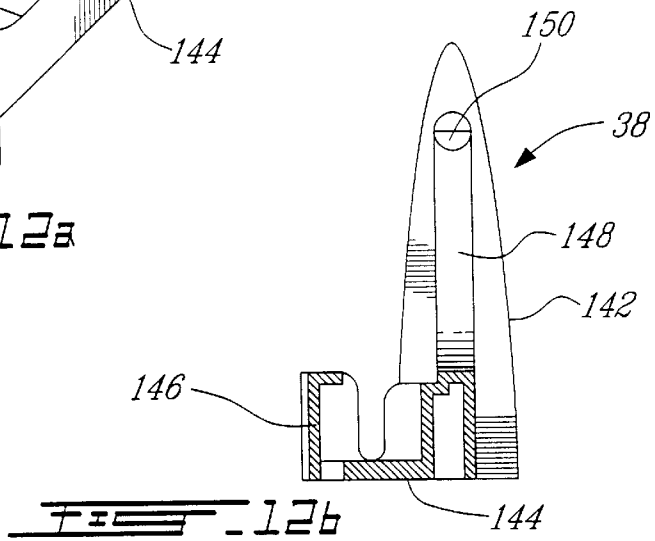

FIGS. 12*a* and 12*b* illustrate the bracket 38 which is detachably secured to the post 24 at the base portion 26, as shown in FIG. 2. The bracket 38 is also a blow-moulded part and includes two upstanding members 142 and a transverse member 144 interconnecting the two upstanding members 142 at the bottoms. The transverse member 144 is provided with a rail 146 at the front side for telescopingly receiving track segments (not shown). One track segment extends end to end between two posts and is adapted to receive a bottom edge of the pool panel, which is well known to those skilled in the art. On the inner side of each upstanding member 142 provided is an elongate shoulder 148 that extends from the transverse member 144 and, in a substantial parallel relationship with respect to the upstanding member 142. A beveled pin 150 extends inwardly from the top end of the elongate shoulder 148. When the bracket 38 is pushed up from the bottom of each post 24, the beveled pin 150 and the elongate shoulder 148 at each side of the blanket 38 are guided through an upstanding slot (not shown) in each side wall 32 of the post 24 until the beveled pin 150 is clicked in a hole (not shown) at the end of the slot so that the blanket 38 is firmly attached to the base portion of the post 24 and the rail 146 is positioned at the front wall 28 of the post 24 for receiving the track segment to support the bottom edge of the pool panel.

Figures 13A, 13B, 13C:
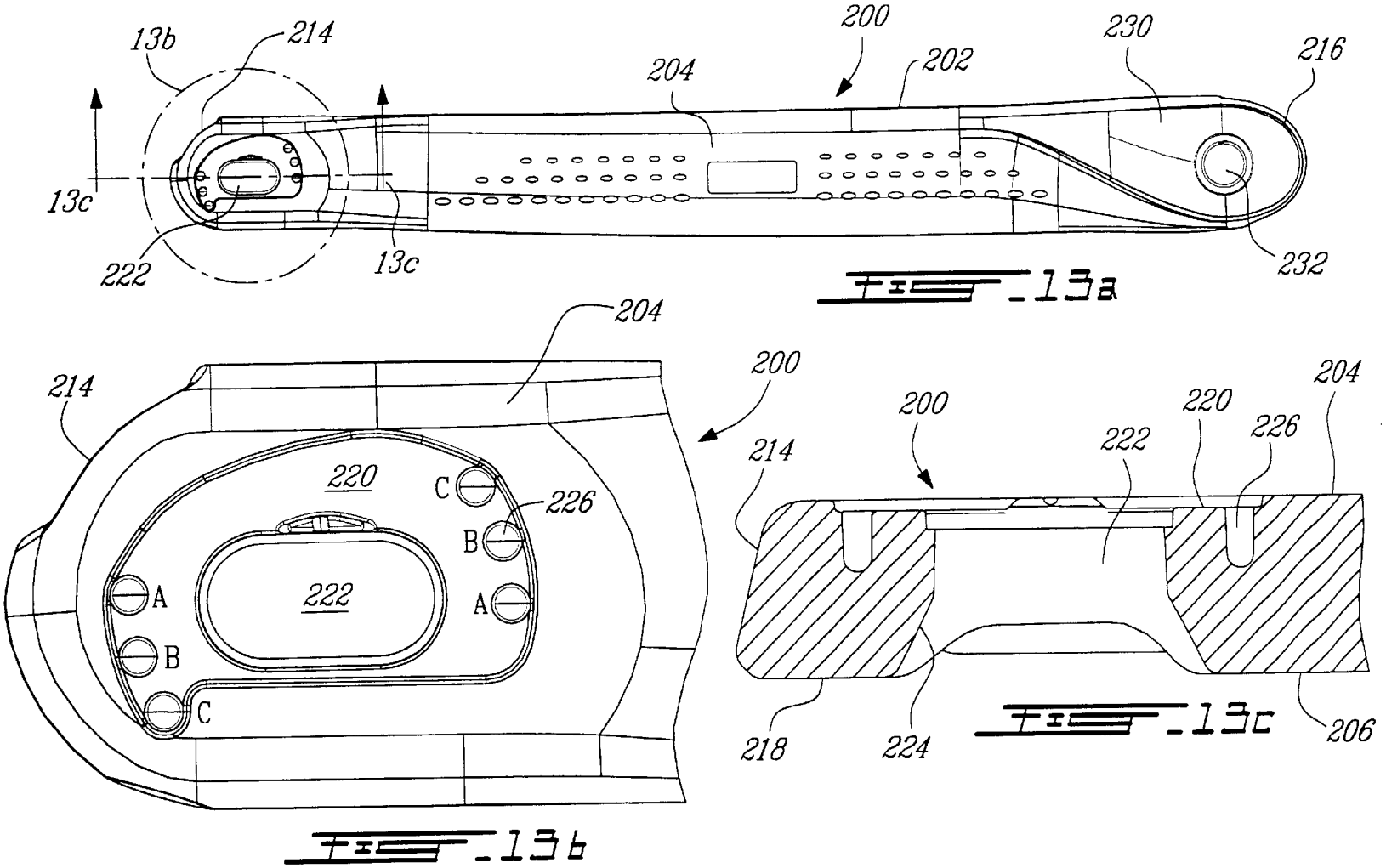
FIG. 13*a* is a top plan view of the universal coping member according to a further embodiment of the present invention.
FIG. 13*b* is an enlarged portion 13*b* of the universal coping member of FIG. 13*a*, showing the hole distribution pattern.
FIG. 13*c* is a cross-sectional view of FIG. 13*b*
Figure 13D:
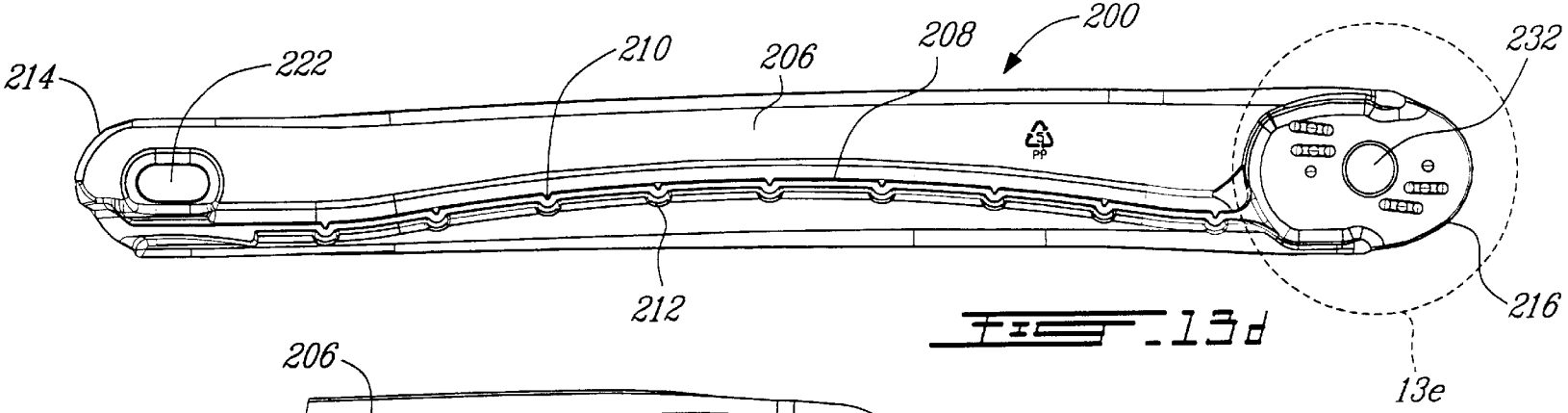
FIG. 13*d* is a bottom plan view of the universal coping member of FIG. 13*a;*
Figure 13E:
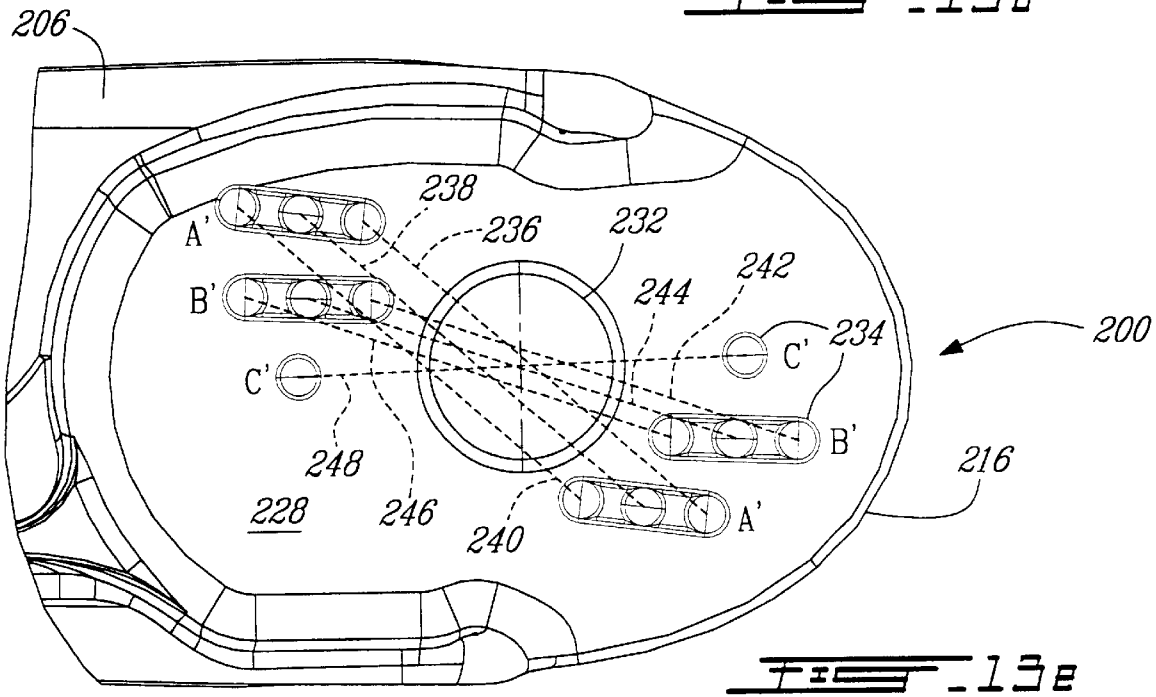
FIG. 13*e* is an elongated portion 13*e* of the universal coping member of FIG. 13*d*, showing the hole distribution pattern.

The holes provided respectively at opposite ends of each coping member can be distributed in different patterns provided that more than one axial position of adjacent coping members relative to each other can be selected when the adjacent coping members are interconnected at the selected angle. For example, a hole distribution pattern according to a further embodiment, different from that shown in FIGS. 7*a* and 7*b* is illustrated in FIGS. 13*a* through 13*e*. Similar to the coping member 20 illustrated in FIG. 3*f*, the coping member 200 has a beam structure 202 with a top surface 204 and a bottom surface 206. A top surface 204 has a decorative design as shown in FIG. 13*a*. A curved coping groove 208 is formed in the bottom surface 206 of the beam structure 202, to receive the top edge of the pool panel (not shown). At one side of the coping groove 208, a plurality of spaced apart projections 210 are provided while a plurality of spaced apart recesses 212 are formed accordingly at the other side of the coping groove 208 to locally deform the top edge of the pool panel received in the coping groove 208, thereby securing the pool panel to the coping member 200.

Each coping member 200 has joint ends 214 and 216 at opposite ends thereof with rounded extremities. The joint end 214 includes a flat seating surface 218 and an upward joint face 220 positioned in a parallel relationship with the seating face 218. An elongate aperture 222 extends through the joint end 214 and is oriented perpendicularly with respect to the upward joint face 220. The elongate aperture 222 includes an enlarged lower section 224. Holes 226 are provided in the upward joint face 220 and are distributed in three groups of two holes spaced apart an equal distance, as indicated by A and A, B and B, and C and C in FIG. 13*b*. Imaginary lines (not shown) connecting the two holes 226 of the respective groups (A, B, and C) are oriented in different directions.

At the other end of the coping member 200, the joint end 216 includes a downward joint face 228 which is level with the upward joint face 220 at the joint end 214. Similar to the coping member 20 in FIG. 3*f*, the joint end 216 further includes an upwardly projecting portion 230 at the top surface 204 for both the strengthening function and the decorative feature. A circular aperture 232 extends through the joint end 214 and is oriented perpendicular to the downward joint face 228. Holes 234 provided in the downward joint face 228 are distributed in three groups A', B'and C'. In each of groups A'and B' there are provided three pairs of corresponding spaced apart holes 234. The relationship of corresponding holes 234 is indicated by imaginary connecting lines 236, 238, 240, 242, 244 and 246, respectively. The holes 234 of each corresponding pair are spaced apart by a distance equal to the distance between the pairs of holes 226 in FIG. 13*b*. The imaginary connecting lines 236, 238 and 240 in group A' are oriented in parallel directions and the imaginary connecting lines 242, 244 and 246 in group B' are also oriented in parallel directions, nevertheless, the imaginary connecting lines in different groups are oriented in different directions. Group C' includes only one pair of holes 234 which are spaced apart by a distance equal to the distance between the pairs of holes 234 in other groups. An imaginary connecting line 248 in group C' is oriented in a direction different from the other imaginary connecting lines of groups A' and B'.

Figure 17C:
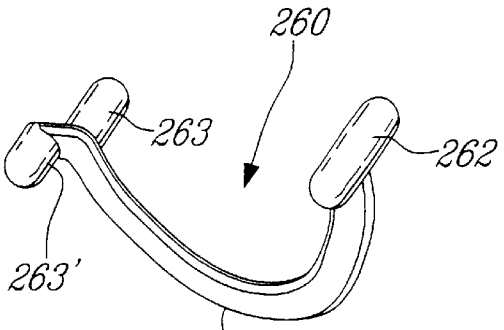
FIGS. 17*a*–17*d* are perspective and side views of two types of pin elements.
Figure 17D:
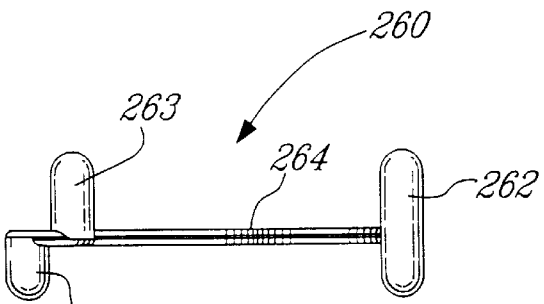
Figure 17A:
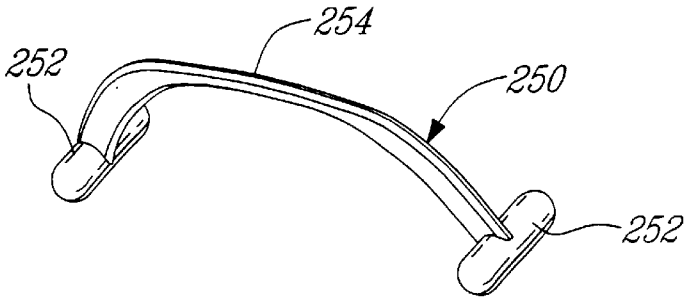
Figure 17B:
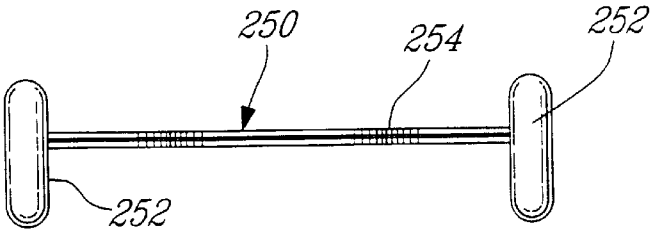

A pin element 250 shown in FIGS. 17*a* and 17*b* is used to selectively engage the holes 226 and 234 in the respective joint ends 214 and 216 of adjacent coping members 200. The pin element 250 includes two spaced apart pins 252 connected by a link member 254. The two pins 252 are spaced apart by a distance equal to the distance between the pairs of holes 226 in the joint end 214. Thus, changes in the groups of the holes 226 in the joint end 214 for engagement with the pin element 250 will change the interconnecting angle of adjacent coping members 200 when the pin element 250 is fitted into selected holes 234 in joint end 216 of the adjacent coping member 200. In this embodiment, the number of the selective angles is three. Similarly, when the pin element 250 is engaged in selected two holes 226 in the joint end 214 of the adjacent coping member 200, changing the pair of holes 234 in the joint end 216 between the groups (for example, from group A' to group B' or C') for engagement with the pin element 250 will change the interconnecting angle of the adjacent coping members, and changing the pair of holes 234 within each group of A' and B' for engagement with the pin element 250 will change the relative axial position of the adjacent coping members at the selected interconnecting angle. The three groups A', B', C' of holes 234 in the joint end 216 and the three groups A, B, C of holes 226 in the joint end 214 in combination, can provide a great number of interconnecting angles for selection.

A still further embodiment of a coping member 300 is illustrated in FIGS. 14*a* through 14*e*. The parts and features of coping member 300 similar to those of coping member 200, are indicated by 300 series numerals with the last two digits corresponding to the last two digits used in FIGS. 13*a* through 13*e*, and will not be redundantly described. A major difference between coping member 300 and coping member 200 is the hole distribution pattern. There are provided, in upward joint face 320 of the joint end 314, six groups of holes 326, each group including a pair of holes 326, as indicated by letters A, B, C, D, E and F. Imaginary lines (not shown) connecting the two holes 326 of the respective groups (A to F) are oriented in different directions. The distances between the two holes 326 in each group are equal with the exception of the distance between holes 326 of group A which is shorter. Holes 334 in the downward joint face 328 of the end 316 are formed in six groups of A', B', C', D', E' and F'. Similar to the holes 234 at the joint end 216 of the coping member 200 shown in FIG. 13*e*, each of groups A' through F' includes pairs of holes 334. The imaginary connecting lines (only three lines in group F' are shown) between each pair of holes 334 in the same group are oriented in parallel directions while the imaginary connecting lines of pairs of holes 334 in different groups are oriented in different directions. It is noted that the distances between the respective pairs of holes 334 are equal to one another as well as to the distances between the two holes 326 of groups B through F at the joint end 314. An exception is, the distance between the two holes 334 of each pair of group A' which is shorter. It is apparent that with respect to coping members 200, the hole distribution pattern of coping members 300 provides a greater number of interconnecting angles for selection.

When selection is made with holes 326 at the joint end 314 and holes 334 at the joint end 316, which have different spaced distances, such as holes 326 of group A and holes 334 of group B', a pin element 260(as shown in FIGS. 17*c* and 17*d*) is used for the engagement. The pin element 260 includes a link member 264 and a pin 262 integrated with one end of the link member 264. At the other end of the link member 264, a pin section 263 is integrated at one side of the link member 264 and another pin section 263' is integrated with the other side of the link member 264. The pin section 263 is not aligned with the pin section 263' so that the distance between the pin 262 and the pin section 263 is shorter than the distance between the pin 262 and the pin section 263'.

Figures 14A, 14B:
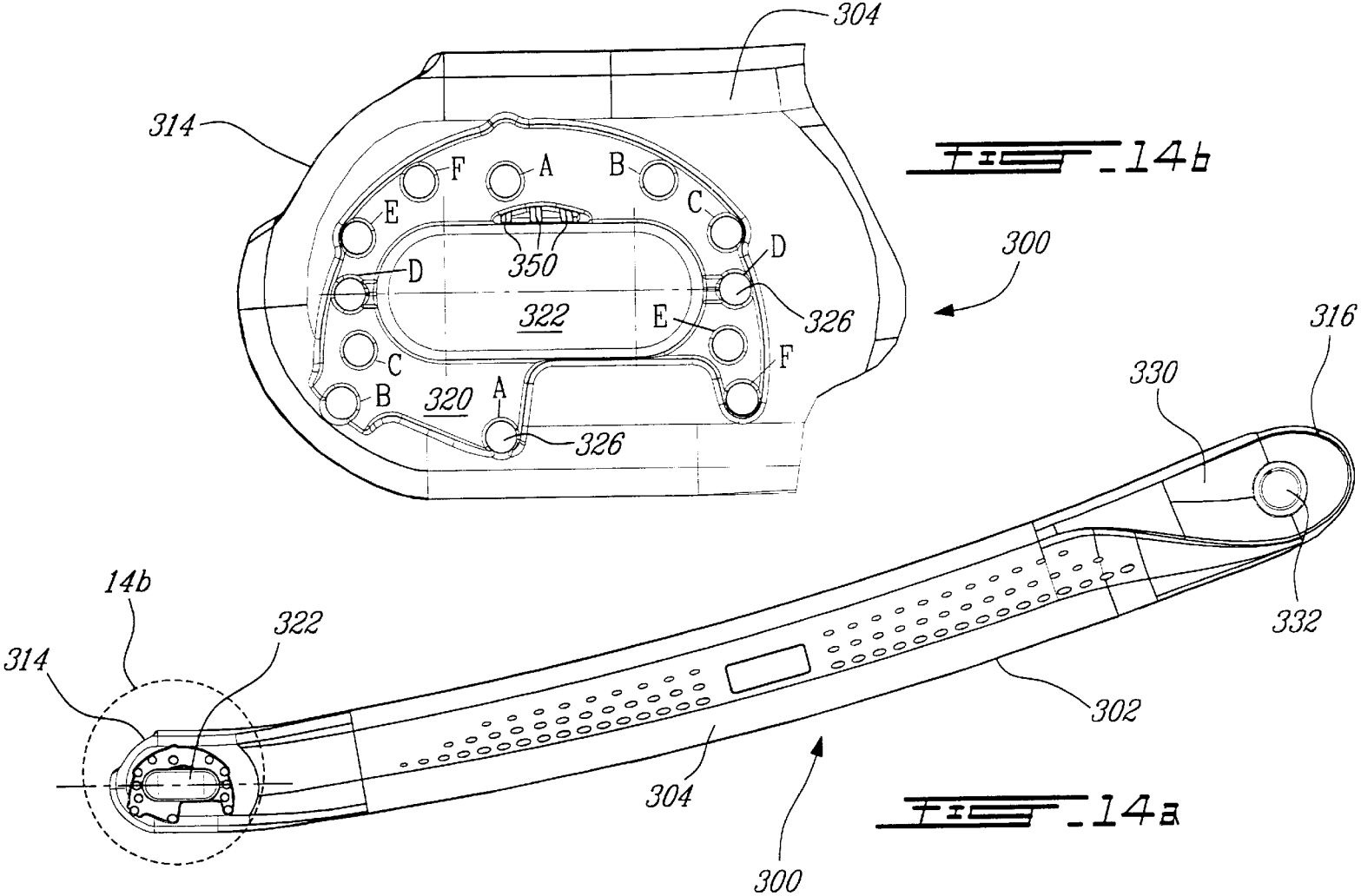
FIG. 14*a* is a top plan view of the universal coping member according to a still further embodiment of the present invention.
FIG. 14*b* is an elongated portion 14*b* of the universal coping member of FIG. 14*a*, showing the hole distribution pattern.
Figure 14C:
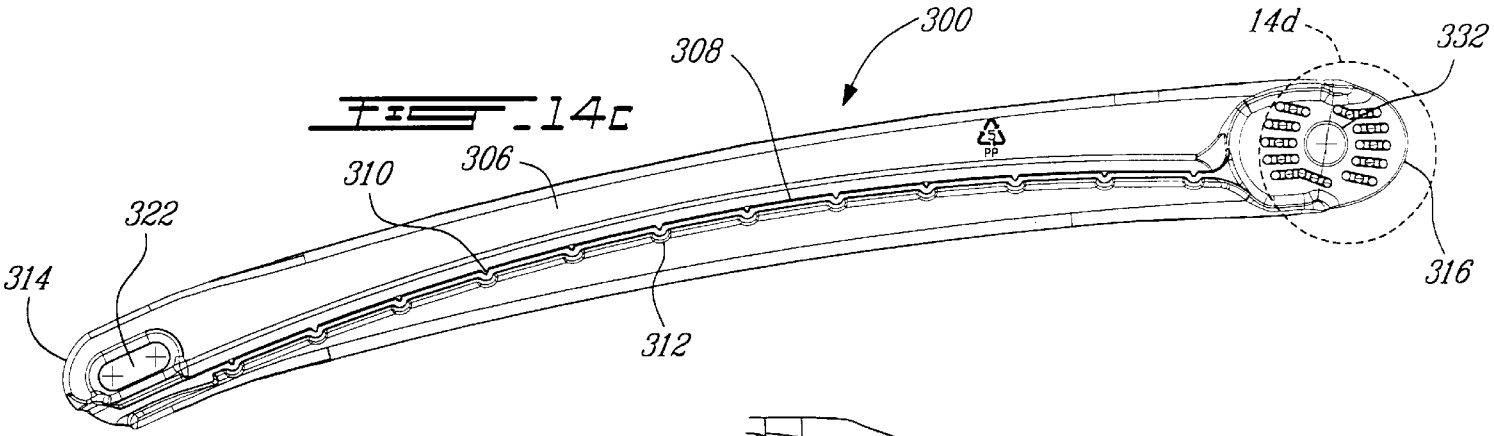
FIG. 14*c* is a bottom plan view of the universal coping member of FIG. 14*a;*
Figure 14D:
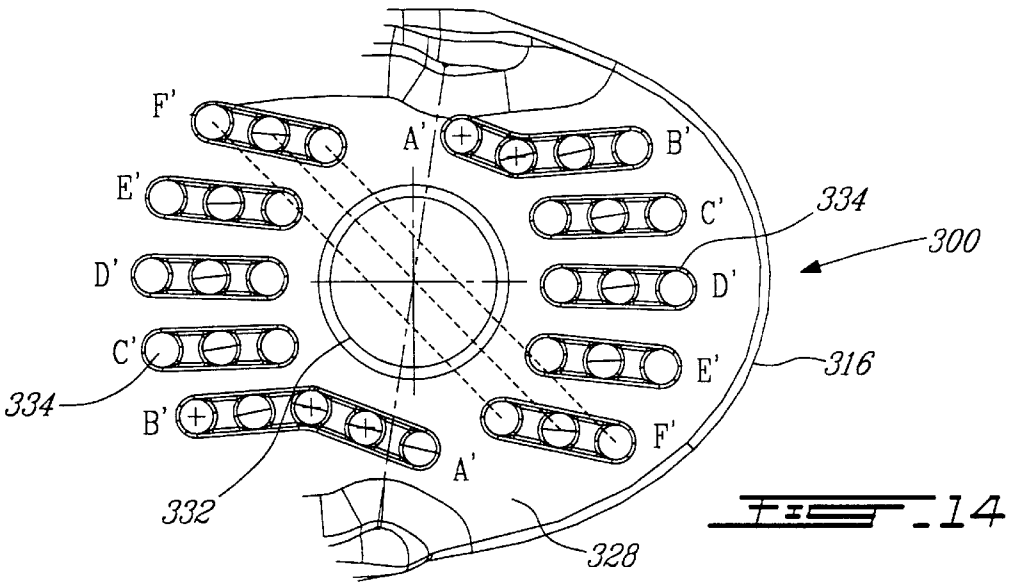
FIG. 14*d* is an elongated portion 14*d* of the universal coping member of FIG. 14*c*, showing a hole distribution pattern.

Most groups of holes 334 at the joint end 316 include three pairs of holes so that three axial positions can be selected at the selected interconnecting angle. As illustrated in FIGS. 14*e* and 14*b* respectively, three marks 350 and one mark 352 are provided on the respective inner peripheries of the elongate aperture 322 at the joint end 314 and on the circular aperture 332 at the joint end 316 for the purpose of assistance in hole alignment because the holes will not be visible while the coping members are being interconnected.

Figure 15:
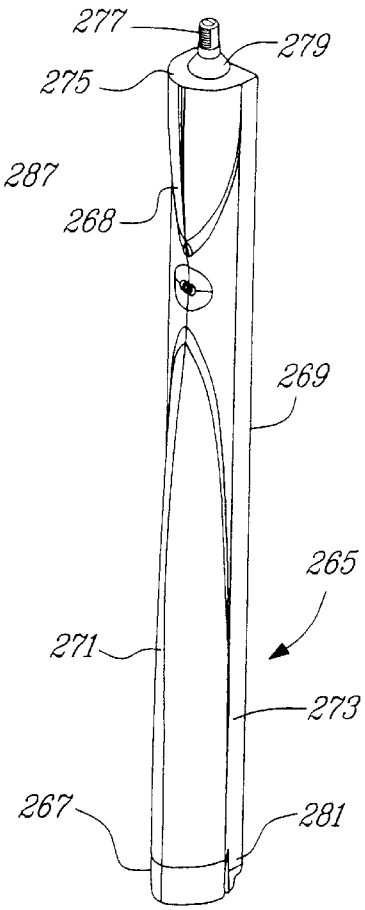
FIG. 15 is a perspective view of a post according to another embodiment.

A post 265 as shown in FIG. 15 is used with the coping members 200 and 300 as shown in FIG. 13*a* and 14*a*, respectively. Similar to the post 24 shown in FIG. 2, the post 265 includes an elongate upstanding blow-moulded plastic member having a base portion 267, a front wall 269, a rear wall 271 and side walls 273. The post 265 is hollow and further includes a top portion 268 having a planer shoulder portion 275 which is provided as the coping seat and an upstanding screw 277 with a truncated conical lower section 279. The screw 277 engages with a threaded cap (not shown) similar to the fastener 120 shown in FIG. 9, to secure the interconnected adjacent coping members to the coping seat 275 of the post 265. The truncated conical lower portion 279 in cooperation with the enlarged lower portion 224 of the elongate aperture 222 of the coping member 200 shown in FIG. 13*c* facilitates the centralized positioning of the elongate aperture 222 of the coping member 200 about the upstanding screw 277 when the flat seating face 218 of the coping member 200, as shown in FIG. 13*c*, abuts the planar shoulder portion 275 of the post 265.

Figure 16B:
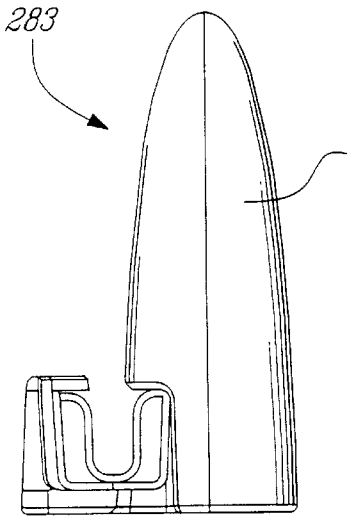
FIGS. 16*a* and 16*b* are perspective and side elevation views of the base element for the post.
Figure 14A:
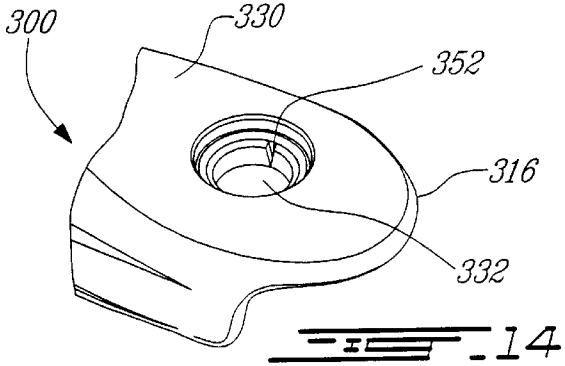
Figure 16A:
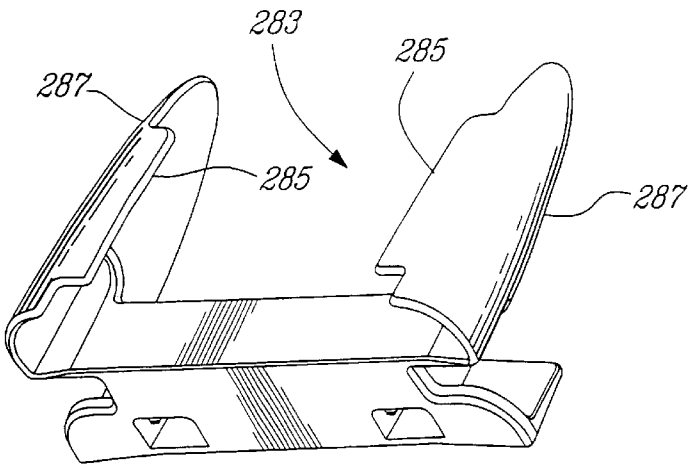

As illustrated in FIG. 15, grooves 281 are provided in the respective side walls 273 at the lower portion 267 of the post 265 for attachment of a bracket 283 shown in FIGS. 16*a* and 16*b*. In comparison with drawings FIGS. 12*a* and 12*b*, it is clear that the bracket 283 is similar to the bracket 38 and will not therefore be redundantly described. The major difference lies in that bracket 283 includes a pair of opposed flat members 285 projecting inwardly from one side of a pair of upstanding members 287 for slidable engagement with the grooves 281 of the post 265.

Figure 19:
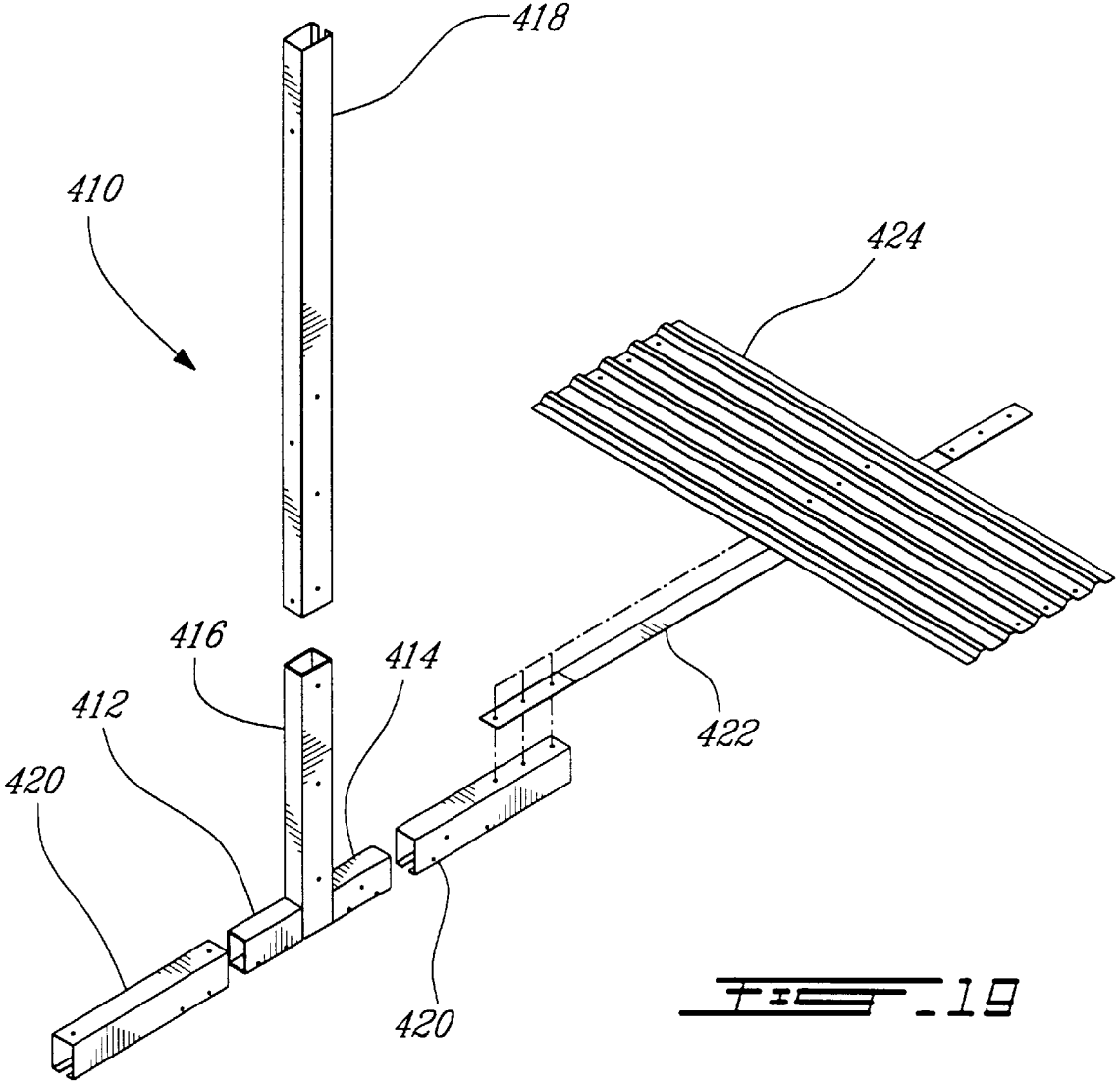
FIG. 19 is an exploded view of an additional support structure used to support the above ground swimming pool of FIG. 18

FIG. 18 illustrates a partial top plan view of an above ground swimming pool using the support structure according to one embodiment of the present invention. The swimming pool, generally indicated by numeral 400 is oval, including straight side walls 402 and curved ends 404. The universal coping members used for this swimming pool 400 include one group of straight coping members 401 used for coping the upper edge of the straight side walls 402, and a group of curved coping members 408 used for coping the upper edge of the curved end walls 404. It is preferred to provide additional reinforcement structures to selectively support a number of the posts 265 against outward water pressure acting on the side walls of the swimming pool. In this embodiment of the present invention, a plurality of T-shaped reinforcement structures 410 are provided to support the posts 265 positioned at the opposite straight side walls 402 of the swimming pool 400. As shown in FIG. 19, the T-shaped reinforcement structure 410 includes a base T-bar 412 having a level section 414 and an upright section 416 extending perpendicularly from the middle of the level section 414. An upright extension member 418 made of an elongate sleeve is telescopically attached to the upright section 416 of the base T-bar 412. Two level extension members 420 made of elongate sleeves are telescopically attached to the opposite ends of the level section 414 of the base T-bar 412. Screws (not shown) are used to secure the extension members 418 and 420 to the base T-bar 412. The base T-bar 412 and the extension members 418 and 420 are made of blow-moulded plastic or other light materials such as aluminum. The T-shaped reinforcement structure 410 is positioned at the selected post 265, the upright extension member 418 abutting the outer wall 271 (see FIG. 15) of the post 265, the level extension members 420 being placed in a recess of the ground such that the upper surface of the level extension members 420 is flush with the ground surface to support the bottom of the post 265.

A reinforcement strap 422 is attached at its one end to the inner end of the level extension member 420 of one T-shaped reinforcement structure by means of screws. The reinforcement strap 422, as shown in FIG. 18, extends beneath the swimming pool liner (not shown) and crosses under the swimming pool 400, being connected at the other end thereof, to a corresponding T-shaped reinforcement structure 410 located at the opposite side of the swimming pool 400. A plurality of deck panels 424 are provided on the ground to cover the inner side of the level extension members 420 of the T-shaped reinforcement structures 410. The deck panels 420 are positioned beneath the pool liner (not shown) such that water pressure acting on the deck panels 424 increases the stability of the T-shaped reinforcement structures 420.

Modifications and improvements to the above-described embodiments of the invention may become apparent to those skilled in the art. The foregoing description is intended to be exemplary rather than limiting. The scope of the invention is therefore intended to be limited solely by the scope of the appended claims.

we claim:

1. A kit for an above ground swimming pool support structure comprising:

a plurality of posts, each post having a base portion and a top portion, each top portion including a substantially planar shoulder portion;

a plurality of elongate coping members, each being provided respectively at opposite ends with a plurality of holes, the coping members being adapted to be interconnected to one another at a selected angle and the interconnected ends of adjacent coping members being adapted to be seated on the planar shoulder portion of the respective posts; and a plurality of pin members, each being adapted for insertion through a selected pair of the holes in the respective adjacent coping members to determine the selected angle from a plurality of predetermined angles at which adjacent coping members may respectively be interconnected, so that an endless top rail supported by the posts is formed to cope a side wall of an above ground swimming pool in preselected sizes and shapes.

2. A kit for an above ground swimming pool support structure as claimed in claim 1 wherein each of the coping members comprises at either end a planar upward joint face and at the remainder end a planar downward joint face, in which the holes are provided respectively, the downward joint face of each coping member being adapted to abut the upward joint face of an adjacent coping member and two selective holes in the downward joint face being adapted to align with two selective holes in the upward joint face to permit two of the respective pin members to extend therethrough to determine the selected angle from the predetermined angles so that the adjacent coping members are interconnected at the selected angle.

3. A kit for an above ground swimming pool support structure as claimed in claim 2 wherein each end of each coping member comprises an opening extending through the coping member perpendicularly with respect to either the upward joint face or the downward joint face for accommodating a fastening means to secure the interconnected ends of the adjacent coping members together with the top portion of the post.

4. A kit for an above ground swimming pool support structure as claimed in claim 3 wherein one of the openings of each coping member is elongated along a longitudinal axis of the coping member.

5. A kit for an above ground swimming pool support structure as claimed in claim 3 wherein the two pin members for connecting the interconnected ends of the adjacent coping members are connected by a link member to form a single piece.

6. A kit for an above ground swimming pool support structure as claimed in claim 5 wherein the holes at the opposed ends of each coping member are distributed in a pattern such that more than one axial position of adjacent coping members relative to each other can be selected when the adjacent coping members are interconnected at the selected angle.

7. A kit for an above ground swimming pool support structure as claimed in claim 1 wherein each coping member comprises means at an underside thereof for supporting an upper edge of the side wall in position.

8. A kit for an above ground swimming pool support structure as claimed in claim 1 wherein means are provided for detachably securing a lower edge of the side wall to the base portion of the respective posts.

9. A kit for an above ground swimming pool support structure as claimed in claim 8 wherein the holes at either end of the coping member are distributed in groups of two holes spaced apart by a distance equal to a distance between the two pin members connected by the link member, imaginary lines connecting the two holes of the respective groups being oriented in different directions, whereby changing the group of the holes for engagement with the two pin members will change the interconnecting angle of adjacent coping members when the two pin members are engaged in two selected holes at the remainder end of the adjacent coping members.

10. A kit for an above ground swimming pool support structure as claimed in claim 8 wherein the holes at either end of the coping member are distributed in groups of holes, each group including pairs of holes, the two holes of each pair being spaced apart by a distance equal to a distance between the two pin members connected by the link member, imaginary lines connecting the two holes of the respective pairs of each group being oriented in parallel directions, and the imaginary lines connecting the two holes of the respective pairs of different groups being oriented in different directions, whereby when the two pin members are engaged in selected two holes at the remainder end of the adjacent coping member, changing the pair of holes between the groups for engagement with the two pin members will change the interconnecting angle of the adjacent coping members, and changing the pair of holes within each group for engagement with the two pin members will change the relative axial position of the adjacent coping members at the selected interconnecting angle.

11. A kit for an above ground swimming pool support structure as claimed in claim 1 further comprises reinforcement members adapted to be assembled into a plurality of substantial T-shaped structures for selective reinforcement of the posts against outward water pressure acting on the pool side wall.

12. A kit for an above ground swimming pool support structure as claimed in claim 1 wherein the elongate coping members comprises a group of coping members having a longitudinal axis curved in a plane defined by the upward and downward joint faces.

13. A kit for an above ground swimming pool support structure as claimed in claim 12 wherein the elongate coping members further comprises a group of coping members having an straight longitudinal axis.

14. An above ground swimming pool comprising:

a pool panel having upper and lower edges, connected end to end to form an endless side wall of the pool;

a liner attached along the endless side wall of the pool;

a plurality of posts, each post having a base portion and a top portion, each top portion including a substantially planar shoulder portion;

a plurality of elongate coping members interconnected one to another, each being provided respectively at opposite ends with a plurality of holes and an opening extending through the end of the coping member;

a plurality of pin members, each being engaged with a selected pair of the holes in the respective adjacent coping members to determine a selected angle from a plurality of predetermined angles at which respective adjacent coping members are interconnected; and the angularly interconnected ends of adjacent coping members being seated at the planar shoulder portion of the respective posts and secured thereto by fastening means extending through the openings so that an endless top rail supported by the posts is formed to cope the endless side wall of the above ground swimming pool in preselected sizes and shapes.

15. An above ground swimming pool as claimed in claim 14 wherein each of the coping members comprises at either end a planar upward joint face and at the remainder end a planar downward joint face, the two joint faces having a common plane, the downward joint face of each coping member abutting the upward joint face of an adjacent coping member, the holes being provided in the upward and downward joint faces and at least two selective holes in the downward joint face being aligned with two selective holes in the upward joint face to permit two of the respective pin members to extend therethrough to determine the selected angle from the predetermined angles so that the adjacent coping members are interconnected at the selected angle.

16. An above ground swimming pool as claimed in claim 15 wherein the holes at the opposite ends of each coping member are distributed in a pattern such that more than one axial position of adjacent coping members relative to each other can be selected at the when the adjacent coping members are interconnected at the selected angle.

17. An above ground swimming pool as claimed in claim 14 wherein each coping member comprises at least one groove at an underside thereof for supporting an upper edge of the side wall in position.

18. An above ground swimming pool as claimed in claim 14 further comprises bracket members, each being detachably secured to the base portion of the respective posts and supporting a lower edge of the side wall.

19. An above ground swimming pool as claimed in claim 14 further comprising a plurality of T-shaped reinforcement structures selectively supporting a number of the posts against outward water pressure acting on the side wall of the pool.

20. An above ground swimming pool as claimed in claim 19 further comprising a plurality of reinforcement strips extending beneath the liner across the pool to connect a pair of the T-shaped reinforcement structures positioned at opposed sides of the pool.

* * * * *